US010534315B2

(12) United States Patent
Midorikawa

(10) Patent No.: US 10,534,315 B2
(45) Date of Patent: Jan. 14, 2020

(54) COOLING DEVICE AND IMAGE FORMING APPARATUS

(71) Applicant: Ruki Midorikawa, Kanagawa (JP)

(72) Inventor: Ruki Midorikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/294,121

(22) Filed: Mar. 6, 2019

(65) Prior Publication Data

US 2019/0302690 A1 Oct. 3, 2019

(30) Foreign Application Priority Data

Mar. 30, 2018 (JP) ..... 2018-067357

(51) Int. Cl.
*G03G 21/20* (2006.01)
*G03G 15/20* (2006.01)

(52) U.S. Cl.
CPC ..... *G03G 21/206* (2013.01); *G03G 15/2064* (2013.01); *G03G 2221/1645* (2013.01)

(58) Field of Classification Search
CPC ..... G03G 15/2064; G03G 15/6573; G03G 21/20; G03G 21/206; G03G 21/1633
USPC ..... 399/91, 92, 107, 110, 114, 124, 405
See application file for complete search history.

(56) References Cited

U.S. PATENT DOCUMENTS 6,522,841 B2 * 2/2003 Horikoshi ..... B65H 29/14 271/211
7,856,193 B2 * 12/2010 Kawamata ..... G03G 15/167 399/92
9,519,267 B2 * 12/2016 Nakamura ..... G03G 15/2017
9,864,338 B2 * 1/2018 Yamanaka ..... G03G 21/1619

FOREIGN PATENT DOCUMENTS

| | | |
|---|---|---|
| JP | 2003-223092 | 8/2003 |
| JP | 2011-191706 | 9/2011 |
| JP | 2011-232427 | 11/2011 |
| JP | 2014-081427 | 5/2014 |

* cited by examiner

*Primary Examiner* — Hoan H Tran
(74) *Attorney, Agent, or Firm* — Harness, Dickey & Pierce, P.L.C.

(57) ABSTRACT

A cooling device includes a duct, an openable cover, and a moving mechanism. The duct is disposed opposite a sheet conveyance path to send air to the sheet conveyance path. The cover exposes the sheet conveyance path when the cover is opened. The moving mechanism moves the duct independently of the cover between an opposite position opposite the sheet conveyance path and a retracted position.

13 Claims, 28 Drawing Sheets

COOLING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2018-067357, filed on Mar. 30, 2018, in the Japan Patent Office, the entire disclosure of which is hereby incorporated by reference herein.

BACKGROUND

Technical Field

Exemplary aspects of the present disclosure relate to a cooling device and an image forming apparatus incorporating the cooling device.

Related Art

Conventionally, image forming apparatuses including a cooling device are known. The cooling device includes a duct, a moving mechanism, and a cover. The duct is disposed opposite a sheet conveyance path to send air to the sheet conveyance path. The moving mechanism moves the duct between a position opposite the sheet conveyance path and a retracted position. The cover opens to expose the sheet conveyance path.

SUMMARY

In at least one embodiment of this disclosure, there is provided a novel cooling device that includes a duct, an openable cover, and a moving mechanism. The duct is disposed opposite a sheet conveyance path to send air to the sheet conveyance path.

The cover exposes the sheet conveyance path when the cover is opened. The moving mechanism moves the duct independently of the cover between an opposite position opposite the sheet conveyance path and a retracted position.

Further provided is an improved image forming apparatus that includes an image recording unit, a fixing unit, and the cooling unit described above. The recording unit records an image on a sheet. The fixing unit, located downstream from the image recording device in a sheet conveyance direction, fixes the image recorded by the image recording unit on the sheet. The cooling unit, located downstream from the fixing device in the sheet conveyance direction, cools the sheet fed from the fixing unit.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
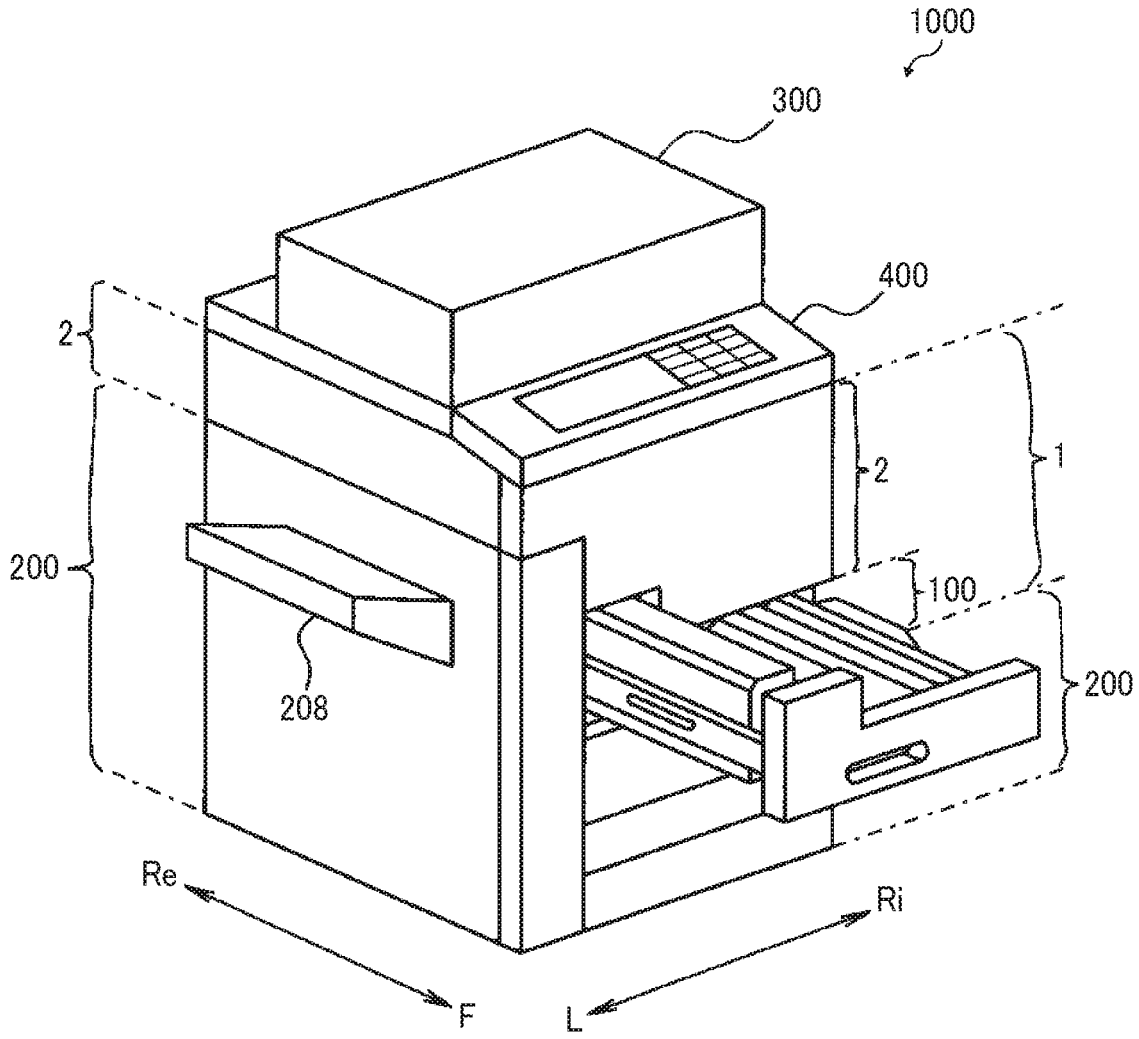
FIG. 1 is a perspective view illustrating a copier according to an embodiment.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner and achieve similar results.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Hereinafter, an embodiment is described using a copier 1000 as an image forming apparatus. First, a basic configuration of the copier 1000 according to the embodiment is described with reference to a perspective view illustrated in FIG. 1. The copier 1000 includes a printer 1 that forms an image in an electrophotographic manner, a sheet feeding and ejecting device 200, a scanner 300 with an automatic document feeder (ADF), and an operation display 400.

The printer 1, which forms an image on a sheet as a recording medium, includes an image forming unit 2 and a sheet conveyance unit 100. As illustrated in FIG. 1, the sheet conveyance unit 100 slides with respect to an apparatus body including the image forming unit 2 of the printer 1 so as to be pulled out from the apparatus body.

In FIG. 1, the copier 1000 is illustrated as seen from the diagonally left front. In the copier 1000, a direction toward the front of the copier 1000 is indicated by an arrow F illustrated in FIG. 1. Moreover, directions toward the rear, right, and left of the copier 1000 are respectively indicated by arrows Re, Ri, and L illustrated in FIG. 1.

Figure 2:
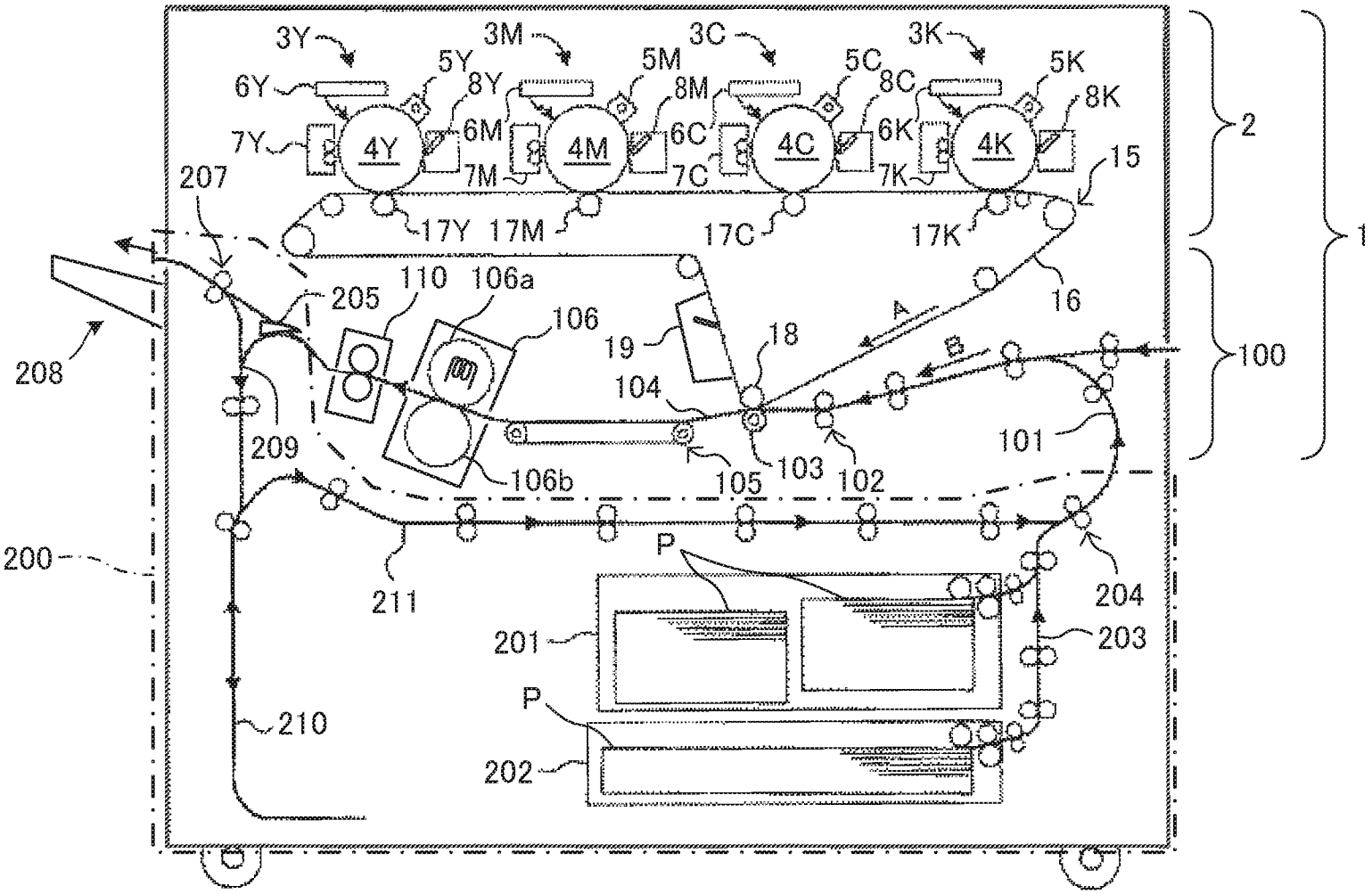
FIG. 2 is a schematic diagram illustrating an internal configuration of a printer and a sheet feeding and ejecting device of the copier as seen from the front of the copier.

FIG. 2 is a schematic diagram illustrating an internal configuration of the printer 1 and the sheet feeding and ejecting device 200 of the copier 1000 as seen from the front of the copier 1000. The image forming unit 2 of the printer 1 includes image formation units 3Y 3M, 3C, and 3K for respectively forming toner images yellow (Y), magenta (M), cyan (C), and black (K). The image formation units 3Y, 3M, 3C, and 3K are spaced a predetermined distance apart from every other in a horizontal direction of the copier 1000. Hereinafter, the suffixes Y, M, C, and K to codes or numerical values indicate members or devices for respective colors of yellow, magenta, cyan, and black.

In addition, the image forming unit 2 includes a transfer unit 15 disposed below the image formation units 3Y, 3M, 3C, and 3K.

Each of the image formation units 3Y, 3M, 3C, and 3K is similar to every other except for the color of toner to be used.

The image formation units 3Y, 3M, 3C, and 3K include drum-shaped photoconductors 4Y, 4M, 4C, and 4K, respectively. Moreover, the image formation units 3Y, 3M, 3C, and 3K include charger 5Y, 5M, 5C, and 5K, exposure devices 6Y, 6M, 6C, and 6K, developing devices 7Y, 7M, 7C, and 7K, and drum cleaners 8Y, 8M, 8C, and 8K that are arranged on the peripheries of the photoconductors 4Y, 4M, 4C, and 4K, respectively. Since a configuration of each of the image formation units 3M, 3C, and 3K is similar to the image formation unit 3Y except for the toner color, the configuration of the image formation units 3Y, 3M, 3C, and 3K is hereinafter described using an example of the image formation unit 3Y for forming a Y-toner image as a representative of the image formation units 3Y, 3M, 3C, and 3K, and description of the image formation units 3M, 3C, and 3K is omitted.

In the image formation unit 3Y, the photoconductor 4Y is rotated counterclockwise in FIG. 2, and a surface of the photoconductor 4Y is uniformly charged by the charger 5Y. Particularly, in a position opposite the charger 5Y, the surface of the photoconductor 4Y is uniformly charged with high voltage having a polarity similar to a toner charge polarity. The uniformly charged surface of the photoconductor 4Y is optically scanned by the exposure device 6Y for emitting laser light that is modulated based on image information. The electric potential on the surface of the photoconductor 4Y irradiated with the light by the optical scanning decays, so that the surface of the photoconductor 4Y bears an electrostatic latent image.

The developing device 7Y selectively attaches Y toner to the electrostatic latent image, so that the electrostatic latent image is developed as a Y toner image. With rotation of the photoconductor 4Y, the Y toner image enters a Y primary transfer nip in which the photoconductor 4Y and an endless intermediate transfer belt 16 (described below) contact each other.

In the transfer unit 15, the intermediate transfer belt 16 is looped around a plurality of rollers arranged inside the loop, and makes an endless movement in a direction indicated by an arrow A illustrated in FIG. 2 by rotation of any one of the rollers.

The intermediate transfer belt 16 is nipped between the photoconductor 4Y and a primary roller 17Y out of the plurality of rollers arranged inside the loop of the intermediate transfer belt 16, thereby forming the Y primary transfer nip in which the photoconductor 4Y and an outer circumferential surface of the intermediate transfer belt 16 contact each other.

The primary roller 17Y receives a primary transfer bias having a polarity opposite to a toner charge polarity, so that a primary transfer electric field is formed in the Y primary transfer nip. The primary transfer electric field electrostatically moves a Y toner image on the photoconductor 4Y toward a surface of the intermediate transfer belt 16. In the Y primary transfer nip, the Y toner image on the photoconductor 4Y is primarily transferred to an outer circumferential surface of the intermediate transfer belt 16 by the primary transfer electric field and a nip pressure.

After passing the Y primary nip, the surface of the photoconductor 4Y has a residual transfer toner that is not primarily transferred to the intermediate transfer belt 16. The drum cleaner 8Y removes the residual transfer toner from the surface of the photoconductor 4Y.

In the image formation units 3M, 3C, and 3K, an M toner image, a C toner image, and a K toner image are respectively formed on surfaces of the photoconductors 4M, 4C, and 4K by electrophotographic processes that are similar to the electrophotographic processes performed by the image formation unit 3Y.

In addition to the primary roller 17Y, primary rollers 17M, 17C, and 17K are arranged inside the loop of the intermediate transfer belt 16. The intermediate transfer belt 16 is nipped between the primary rollers 17M, 17C, and 17K and the respective photoconductors 4M, 4C, and 4K, thereby forming M, C, and K primary transfer nips in which the outer circumferential surface of the intermediate transfer belt 16 contacts the photoconductors 4M, 4C, and 4K.

In the M, C, and K primary transfer nips, the M toner image, the C toner image, and the K toner image are sequentially overlapped and primarily transferred to the Y toner image which has been transferred to the outer circumferential of the intermediate transfer belt 16. Accordingly, a four-color toner image is formed on the outer circumferential of the intermediate transfer belt 16.

A secondary transfer roller 103 is disposed below the intermediate transfer belt 16. The intermediate transfer belt 16 is nipped between the secondary transfer roller 103 and a secondary transfer counter roller 18 disposed inside the loop of the intermediate transfer belt 16, thereby forming a secondary nip in which the outer circumferential surface of the intermediate transfer belt 16 contacts the secondary transfer roller 103. In the secondary transfer nip, a secondary transfer electric field is formed between the secondary transfer counter roller 18 to which a secondary transfer bias having a polarity similar to the toner charge polarity is to be applied and the secondary transfer roller 103 that is electrically grounded.

The four-color toner image formed on the outer circumferential surface of the intermediate transfer belt 16 enters the secondary transfer nip with the endless movement of the intermediate transfer belt 16.

The sheet feeding and ejecting device 200 of the copier 1000 includes a sheet feeding bank 201 and a sheet cassette 202 that are arranged below the sheet conveyance unit 100 of the printer 1. A sheet P fed from the sheet feeding bank 201 or the sheet cassette 202 to a sheet supply path 203 is conveyed upward by a plurality of conveyance roller pairs arranged along the sheet supply path 203. Then, the sheet P is delivered to a sheet feed path 101 in the sheet conveyance unit 100 of the printer 1 by a delivery roller pair 204 disposed near an end of the sheet supply path 203.

The sheet P delivered to the sheet feed path 101 from the sheet supply path 203 is conveyed in a direction indicated by an arrow B by a plurality of conveyance roller pairs arranged along the sheet feed path 101. Then, the sheet P contacts a registration nip between a pair of registration rollers 102 disposed near an end of the sheet feed path 101, so that a skew of the sheet P is corrected. Subsequently, with rotation of the registration roller pair 102, the sheet P is fed toward the secondary nip in synchronization with the four-color toner image on the intermediate transfer belt 16.

In the secondary transfer nip, the four-color toner image on the intermediate transfer belt 16 closely contacts the sheet P, and is secondarily transferred to the sheet P by a secondary transfer electric field and a nip pressure. Accordingly, a full-color image is formed on the white sheet P.

On the outer circumferential surface of the intermediate transfer belt 16 having passed the secondary nip, a residual transfer toner that is not secondarily transferred to the sheet P is attached. Such a residual transfer toner is removed from the intermediate transfer belt 16 by a belt cleaner 19.

In addition to the sheet feed path 101, the registration roller pair 102, and the secondary transfer roller 103, the sheet conveyance unit 100 of the printer 1 includes a post-transfer conveyance path 104, a sheet conveyance belt unit 105, a fixing device 106, and a conveying cooling unit 110 as a cooling device.

The sheet P having passed the secondary transfer nip is fed to the post-transfer conveyance path 104. The sheet P on the post-transfer conveyance path 104 is conveyed via the sheet conveyance belt unit 105, the fixing device 106, and the conveying cooling unit 110.

In FIG. 2, the sheet P fed to the post-transfer conveyance path 104 is first conveyed from the right side toward the left side of the copier 1000 by the sheet conveyance belt unit 105. Then, the sheet P is fed to the fixing device 106.

The fixing device 106 includes a heat source 106*a* such as a halogen lamp, and a pressing roller 106*b* that is pressed toward the heat source 106*a*, and the heat source 106*a* and the pressing roller 106*b* contact each other to form a fixing nip. The sheet P fed to the fixing device 106 enters the fixing nip in which heat and pressure are applied, so that the full-color image on the surface of the sheet P is fixed.

The sheet P having passed the fixing device 106 is fed to a left end portion of the sheet feeding and ejecting device 200 illustrated in FIG. 2 via the conveying cooling unit 110.

In the left end portion of the sheet feeding and ejecting device 200, a switching tab 205, a sheet ejection path 206, an ejection roller pair 207, a return path 209, and a switchback path 210 are arranged. Moreover, a re-supply path 211 is provided above the sheet feeding bank 201 in the sheet feeding and ejecting device 200.

The sheet P is delivered to the left end portion of the sheet feeding and ejecting device 200 from the conveying cooling unit 110 disposed in the sheet conveyance unit 100 of the printer 1, and a subsequent destination of the sheet P is selected by the switching tab 205. When a single-sided mode in which an image is formed on only one side of a sheet P is used, or duplex printing by a duplex mode in which images are formed on two sides of a sheet P is finished, the sheet ejection path 206 is selected as a destination of the sheet P. The sheet P fed to the sheet ejection path 206 is ejected outside via the ejection roller pair 207 and then stacked on the stacking tray 208.

On the other hand, when printing of an image on one side in the duplex mode is finished, the return path 209 is selected as a destination of the sheet P. The sheet P fed to the return path 209 enters the switchback path 210. Then, the sheet P is vertically inverted by switchback and fed to the re-supply path 211. The sheet P is again fed to the sheet feed path 101 via the re-supply path 211. Subsequently, a full-color image is secondarily transferred to the other side of the sheet P in the secondary transfer nip, and the sheet P is ejected outside after passing the fixing device 106, the conveying cooling unit 110, the sheet ejection path 206, and the ejection roller pair 207 in sequence.

The sheet P having passed the fixing device 106 has high temperature. In recent years, high-speed printing has been promoted. In a case where a sheet P is conveyed with the temperature of the sheet P remaining high, an image on the sheet P is disturbed more easily, or a blocking phenomenon in which sheets P adhere to each other occurs more easily.

The conveying cooling unit 110 cools the sheet P to be fed from the fixing device 106 while conveying the sheet P.

Figure 3:
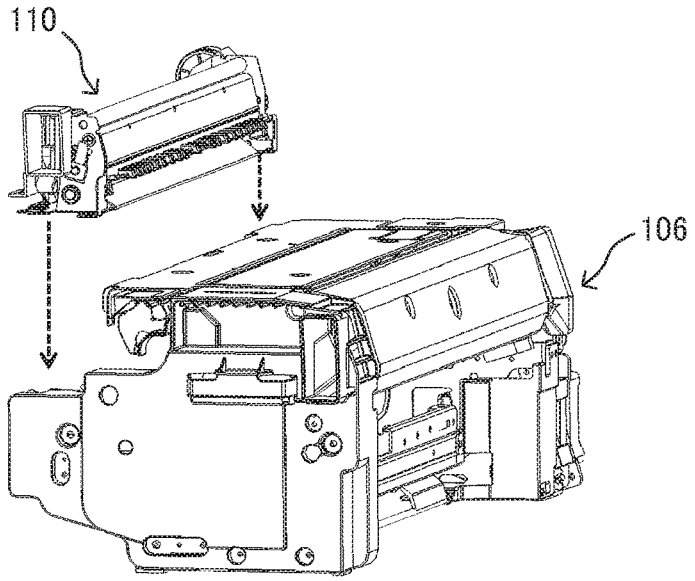
FIG. 3 is a perspective view illustrating a fixing device and a conveying cooling unit of the copier.

FIG. 3 is a perspective view illustrating the fixing device 106 and the conveying cooling unit 110. The conveying cooling unit 110 is attached to the fixing device 106 as illustrated by arrows in FIG. 3 such that the conveying cooling unit 110 can cool a sheet immediately after ejected from the fixing device 106 while conveying the sheet.

Figure 4:
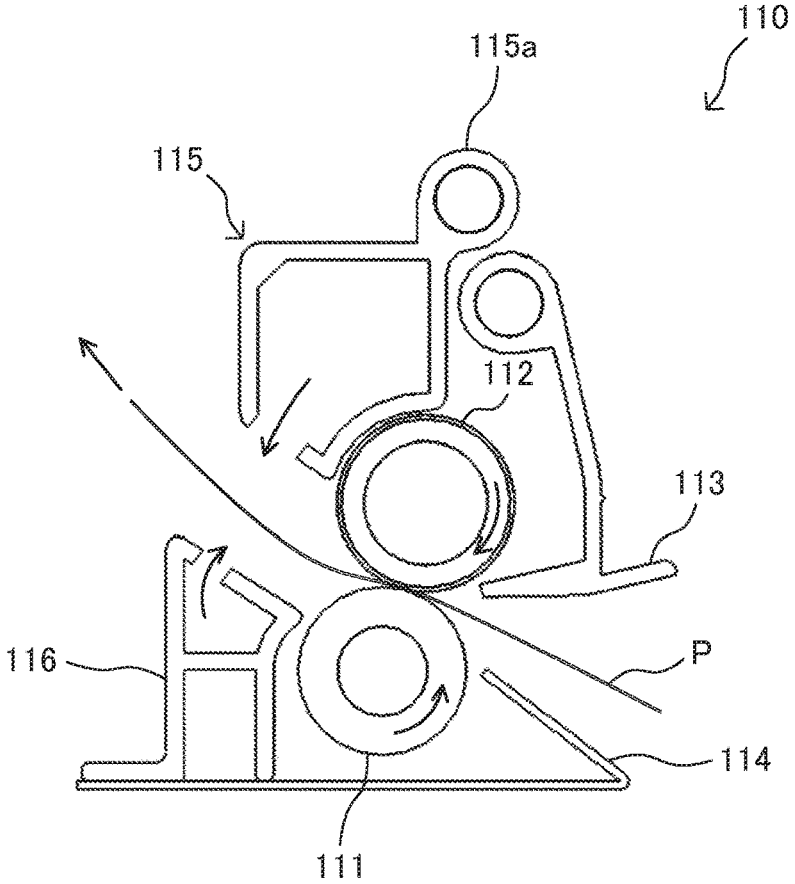
FIG. 4 is a cross-sectional view illustrating the conveying cooling unit and a sheet being conveyed.

FIG. 4 is a cross-sectional view illustrating the conveying cooling unit 110 and a sheet P being conveyed. The conveying cooling unit 110 includes a drive roller 111 that rotates, and a driven roller 112 that is pressed by the drive roller 111. The drive roller 111 and the driven roller 112 contact each other to form a conveyance nip. The conveying cooling unit 110 applies a conveyance force to the sheet P nipped in the conveyance nip.

Moreover, the conveying cooling unit 110 includes an upper nip guide 113, a lower nip guide 114, an upper blower duct 115, and a lower blower duct 116. Immediately after the sheet P is fed from the fixing device 106, the sheet P is provided between the upper nip guide 113 and the lower nip guide 114, and guided toward the conveyance nip.

The air from the upper blower duct 115 is sprayed on the top surface of the sheet P having passed the conveyance nip, whereas the air from the lower blower duct 116 is sprayed on the bottom surface of the sheet P. Accordingly, the sheet P heated by the fixing device 106 is cooled from both sides.

Figure 5:
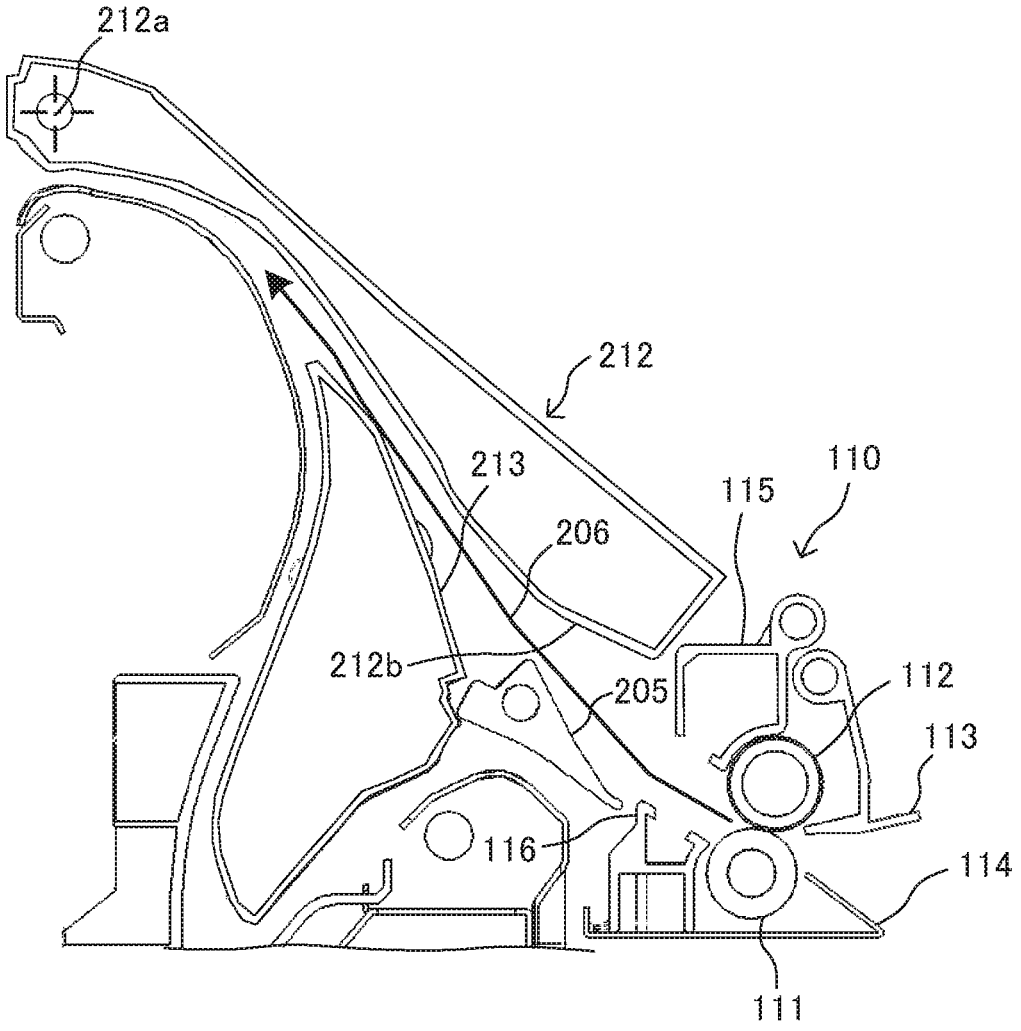
FIG. 5 is a sectional view illustrating the conveying cooling unit and the periphery of a sheet ejection path.

FIG. 5 is a sectional view illustrating the conveying cooling unit 110 and the periphery of the sheet ejection path 206. As illustrated in FIG. 5, the conveying cooling unit 110 of the sheet conveyance unit 100 of the printer 1 is disposed in the vicinity of the sheet ejection path 206 of the sheet feeding and ejecting device 200.

The sheet ejection path 206 is formed between an openable cover 212 and a lower ejection guide 213 with the switching tab 205. The cover 212 can be rotated about a hinge 212*a*. If a sheet P is jammed within the sheet ejection path 206, the rotation of the cover 212 out of the way exposes the jammed sheet P and enables the jammed sheet P to be removed from the sheet ejection path 206. The cover 212 in a state illustrated in FIG. 5 is rotated counterclockwise about the hinge 212*a*. Such rotation of the cover 212 exposes the sheet ejection path 206, so that the sheet P on the sheet ejection path 206 can then be removed with ease.

Figure 6:
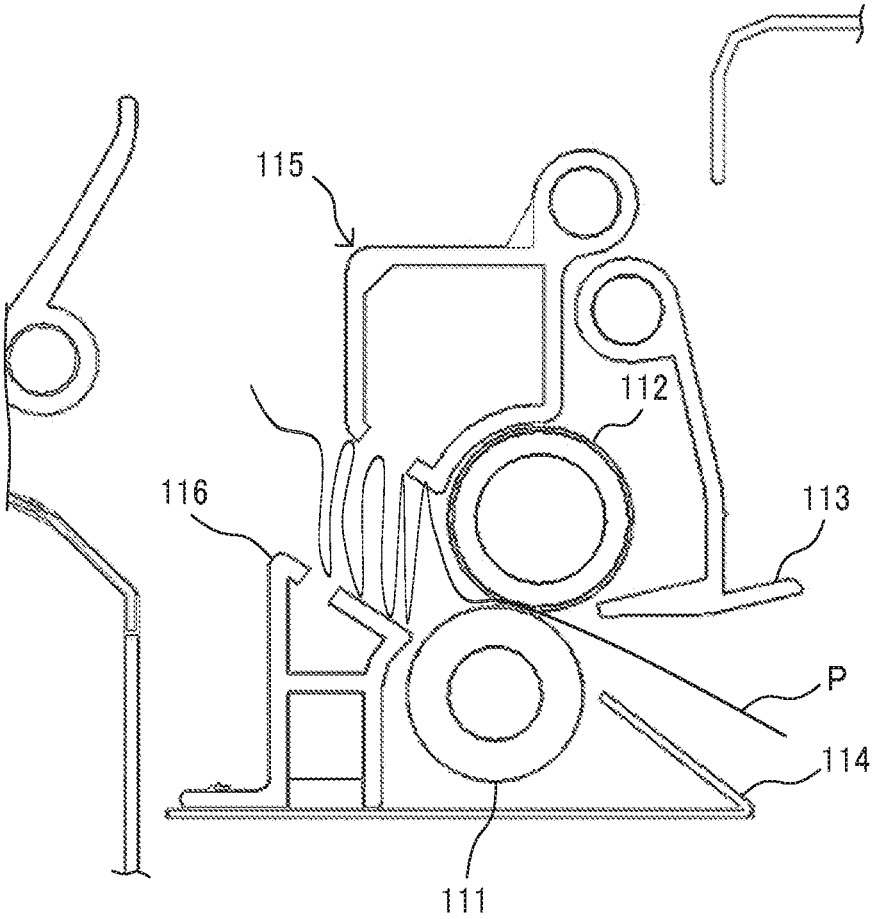
FIG. 6 is a sectional view illustrating a sheet jam inside the conveying cooling unit.

As illustrated in FIG. 6, a sheet P may be jammed inside the conveying cooling unit 110 before being fed to the sheet ejection path 206. If such a sheet jam occurs, preferably the upper blower duct 115 positioned opposite the post-transfer conveyance path 104 is movable to a retracted position away from the sheet ejection path 206 such that the sheet P is readily removed from the conveying cooling unit 110.

Figure 7:
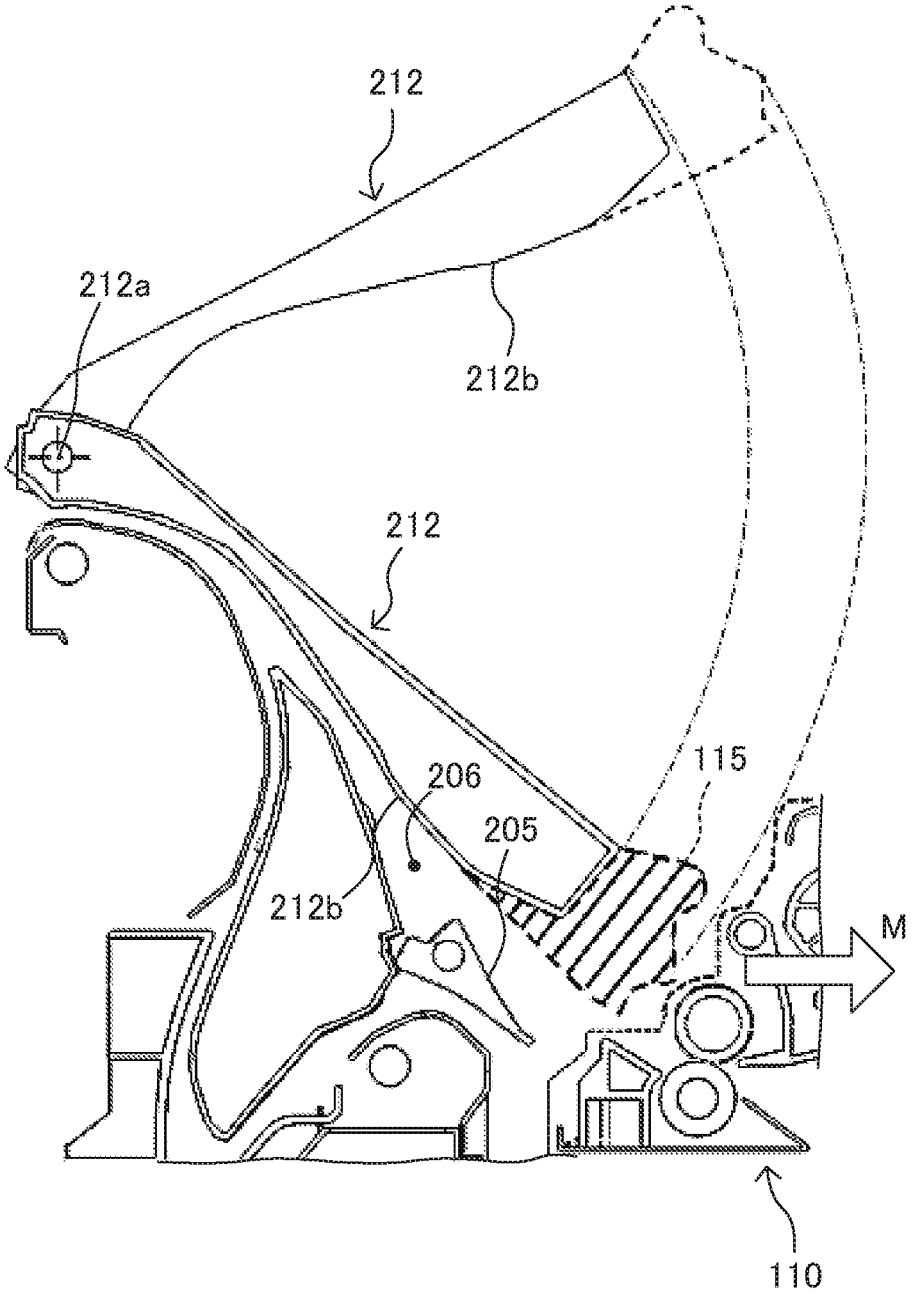
FIG. 7 is a sectional view illustrating the periphery of the sheet ejection path in the sheet feeding and ejecting device.

In an image forming apparatus, a guide in the vicinity of a blower duct may be moved with a blower duct, so that a sheet jammed directly below the blower duct is removed. If such a configuration is applied to the copier 1000, as illustrated in FIG. 7, the upper blower duct 115 is rotated with the cover 212 about the hinge 212*a* of the cover 212. Consequently, as illustrated with a dotted line in FIG. 7, a rotation radius of the upper blower duct 115 with the cover 212 is larger than a rotation of radius of the cover 212 alone, causing an increase in size of the copier. Moreover, since the upper blower duct 115 and the cover 212 which are rotated with a large radius need to avoid contacting other components that are not to be rotated, layout flexibility can be degraded. In such a copier, a portion other than the upper blower duct 115 in the conveying cooling unit 110 needs to be moved in a direction indicated by an arrow M illustrated in FIG. 7 to avoid interfering with the upper blower duct 115. Accordingly, the fixing device 106 also needs to be moved in the same direction, complicating the configuration.

Figure 8:
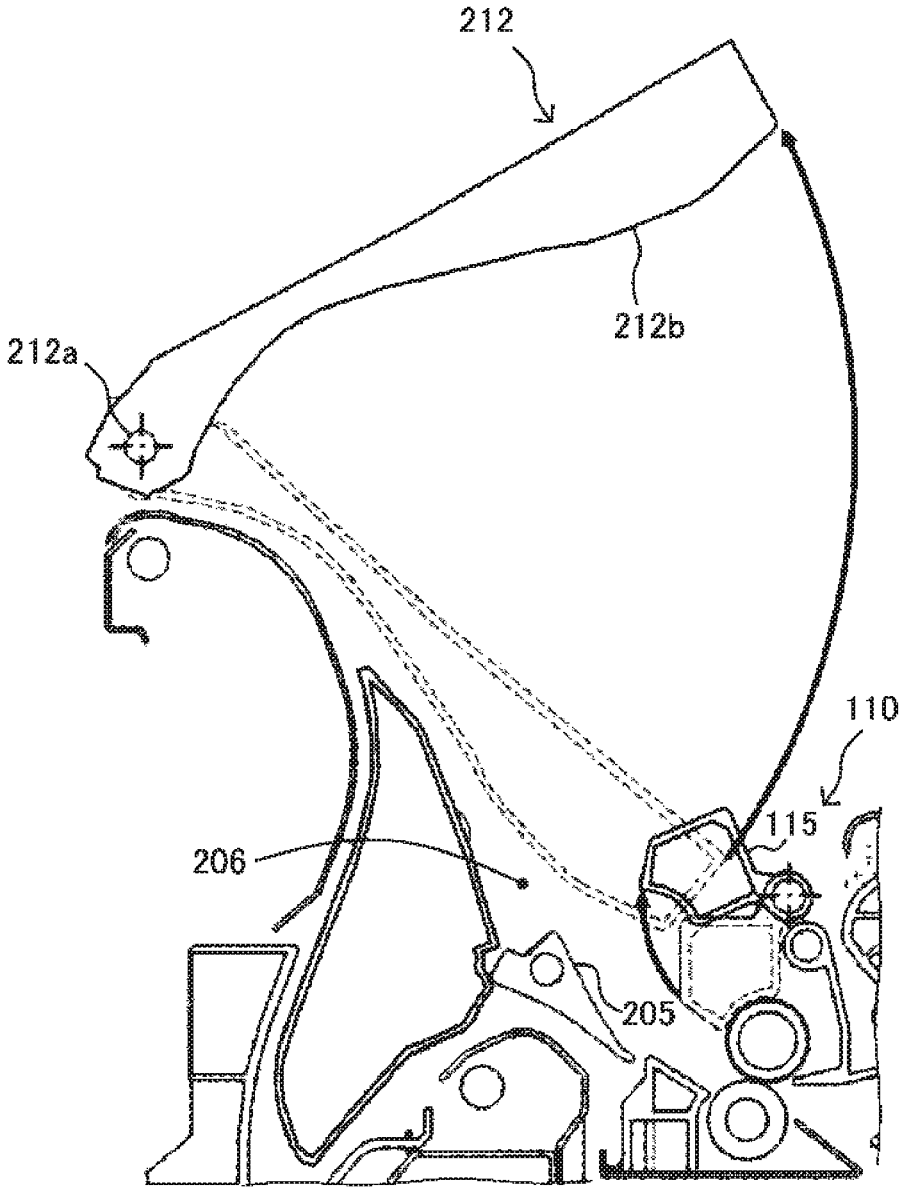
FIG. 8 is a sectional view illustrating a cover and the periphery of the cover in the copier.

Next, a description is given of a configuration of the copier. FIG. 8 is a sectional view illustrating the cover 212 and the periphery of the cover 212. In the copier, the cover 212 is not integrally rotated with the upper blower duct 115. The cover 212 is rotated independently from the upper blower duct 115 to open the sheet ejection path 206.

The cover 212 includes an upper ejection guide 212*b* for guiding one side of a sheet. When the cover 212 is opened, the upper ejection guide 212*b* is moved. Such a movement of the upper ejection guide 212*b* enables the sheet ejection path 206 on downstream of the upper blower duct 115 in a sheet conveyance direction to be opened (exposed). A user can pull out a jammed sheet near the upper blower duct 115 from the downstream side in the sheet conveyance direction, thereby readily removing the jammed sheet.

The upper ejection guide 212*b* guides a sheet in a position downstream of a position opposite the upper blower duct 115 on the sheet ejection path 206 in the sheet conveyance direction. When the upper blower duct 115 is moved to a retracted position indicated by a solid line illustrated in FIG. 8 from an opposite position indicated by a broken line illustrated in FIG. 8, a portion that is within the upper blower duct 115 and opposite the sheet ejection path 206 (a lower surface of the upper blower duct 115 indicated by a broken line in FIG. 8) is moved to the downstream side in the sheet conveyance direction (in an upper left direction in FIG. 8). When the user opens the cover 212 and pulls the jammed sheet toward the downstream side in the sheet conveyance direction, the upper blower duct 115 moves to the downstream side in the sheet conveyance direction by following the movement the jammed sheet. Since the upper blower duct 115 does not tend to interfere with the movement of the jammed sheet, the jammed sheet can be removed more easily.

Figure 9:
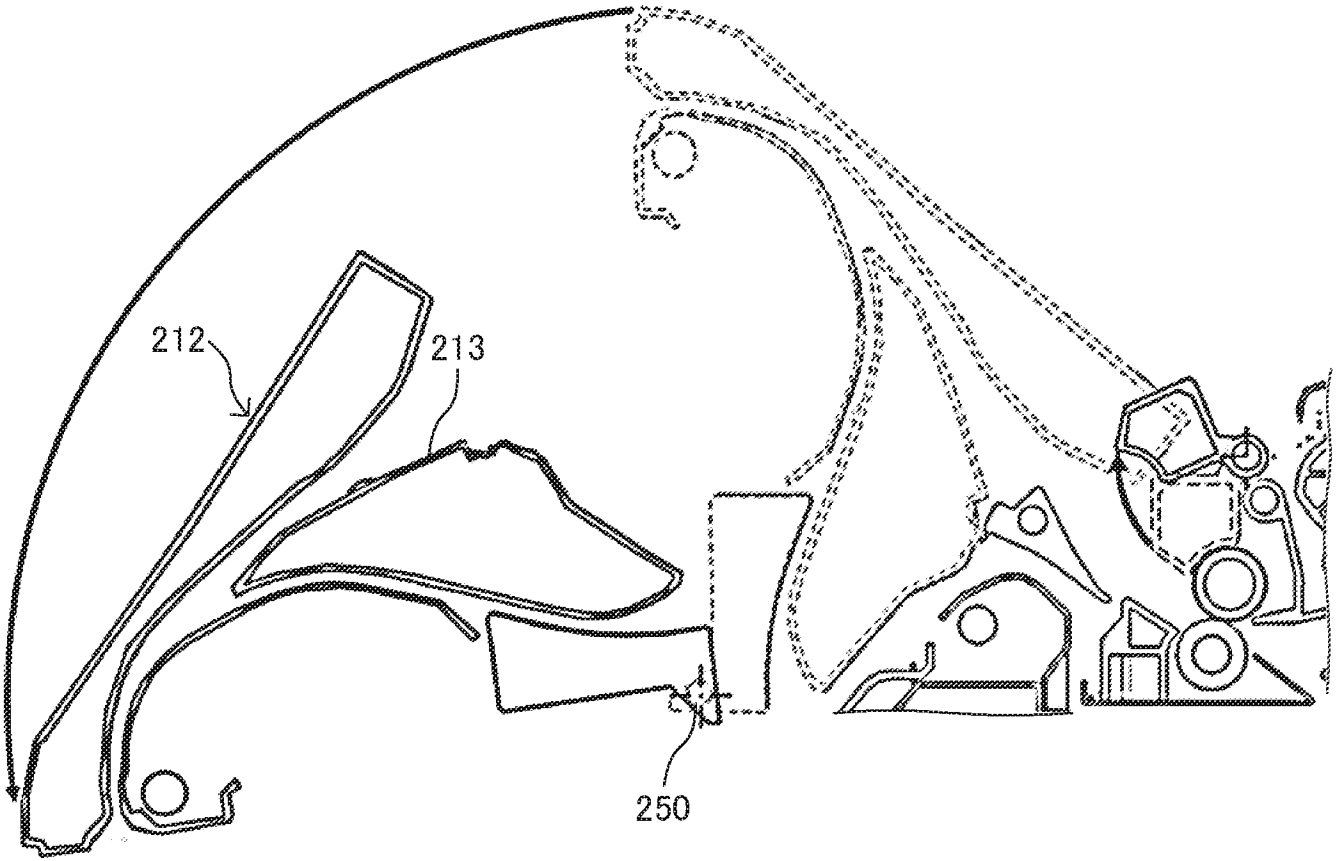
FIG. 9 is a sectional view illustrating a modification of an exterior cover of the copier.

In such a copier, the cover 212 does not function as an exterior cover of the copier. However, the cover 212 may also function as an exterior cover. In such a case, as illustrated in FIG. 9, the cover 212 can be integrally rotated with a member such as the lower ejection guide 213 about a hinge 250 instead of being independently rotated.

That is, the cover 212 includes the upper ejection guide 212*b* and the lower ejection guide 213 for guiding respective sides of a sheet. When the cover 212 is opened, the upper ejection guide 212*b* and the lower ejection guide 213 are moved. Such movements enable the sheet ejection path 206 on downstream of the upper blower duct 115 in the sheet conveyance direction to be opened (exposed). The user can pull out a jammed sheet near the upper blower duct 115 from the downstream side in the sheet conveyance direction, thereby readily removing the jammed sheet.

Figure 10:
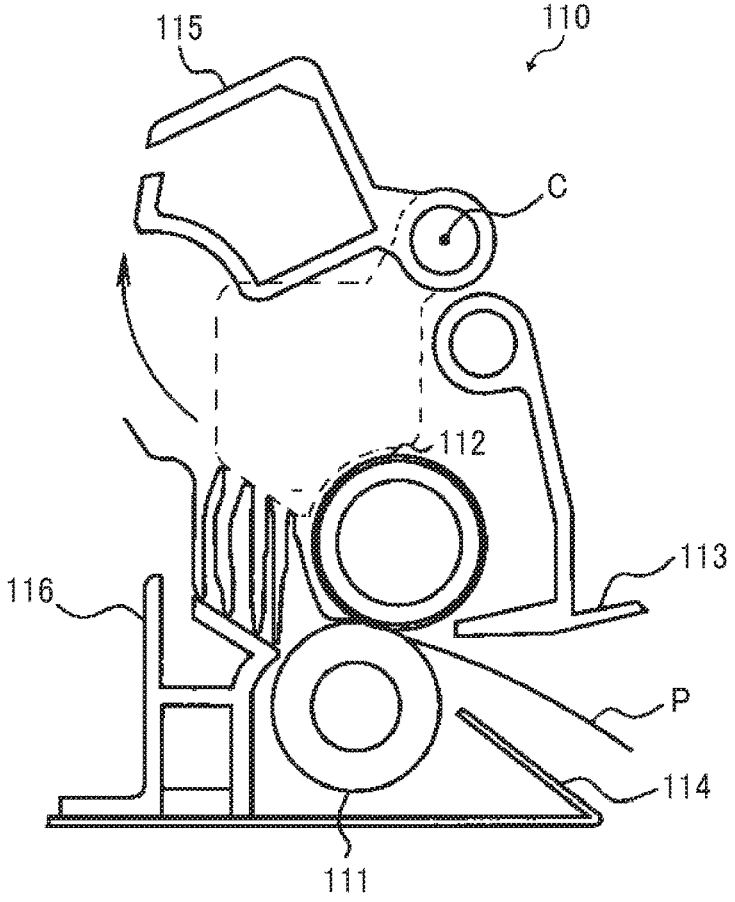
FIG. 10 is a cross-sectional view illustrating the conveying cooling unit in a state in which an upper blower duct is moved to a retracted position.

FIG. 10 is a cross-sectional view illustrating the conveying cooling unit 110 in a state in which the upper blower duct 115 is moved to a retracted position. The upper blower duct 115 can be moved between an opposite position indicated by a dotted line in FIG. 10 and a retracted position indicated by a solid line in FIG. 10. In FIG. 10, the transfer unit 15 is present in the retracted position. Accordingly, the upper blower duct 115 is moved independently from the lower ejection guide 213 and the upper ejection guide 212*b* of the cover 212. Such a configuration enables the upper blower duct 115 to be retracted to a position allowing removal of a jammed sheet by moving the upper blower duct 115 for a shorter distance than a distance according to a configuration in which the upper blower duct 115 is moved together with the lower ejection guide 213 and the upper ejection guide 212*b*. Thus, the movement of the upper blower duct 115 between the opposite position and the retracted position can prevent an increase in size of the apparatus.

Moreover, flexibility in the direction in which the transfer unit 15 is moved is greater than a case in which the upper blower duct 115 is moved together with the cover 212 and the guide. Hence, greater layout flexibility can be achieved. Moreover, since the upper blower duct 115 can be moved to the retracted position without movement of the fixing device 106 and a portion other than the upper blower duct 115 of the conveying cooling unit 110 in the direction M illustrated in FIG. 7, an overcomplicated configuration can be avoided.

Figure 11:
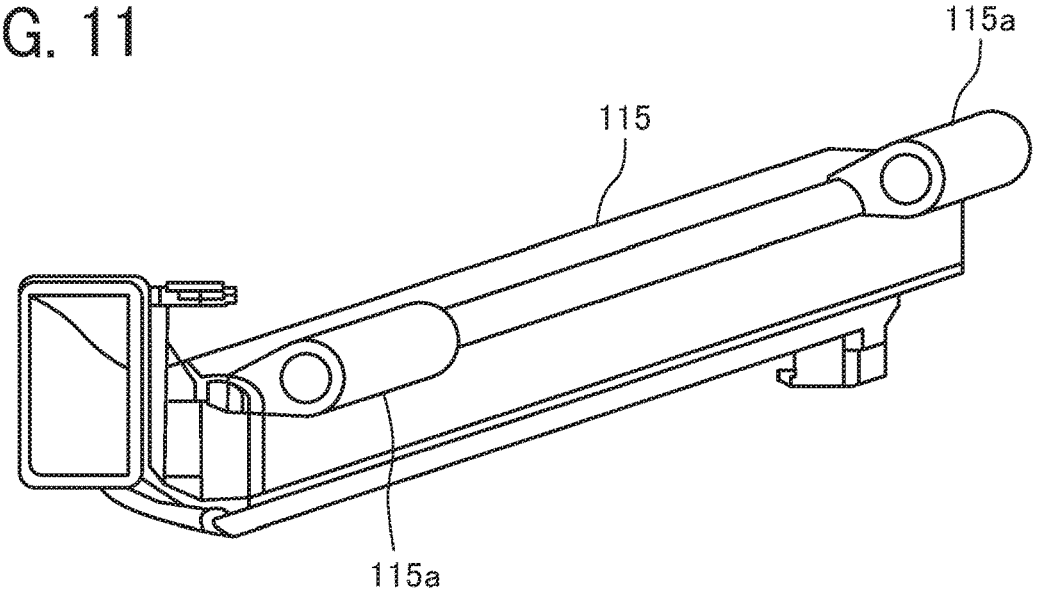
FIG. 11 is a perspective view illustrating the upper blower duct.

FIG. 11 is a perspective view illustrating the upper blower duct 115. Each of both end portions of the upper blower duct 115 in a longitudinal direction has a slide bearing 115*a*.

Figure 12:
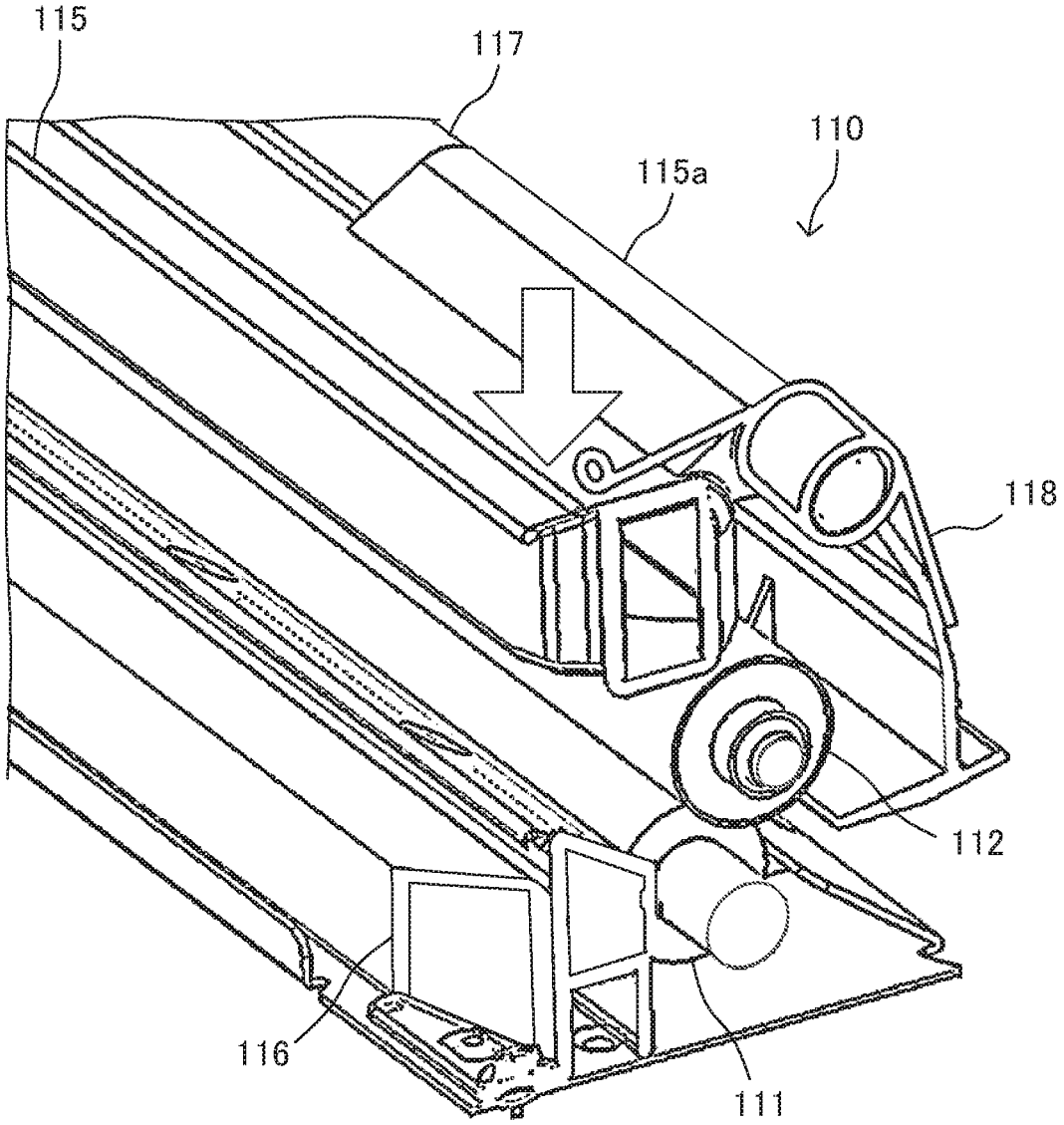
FIG. 12 is a partial perspective view illustrating one end portion of the conveying cooling unit in a longitudinal direction (an end portion of the conveying cooling unit on the front side of the copier)
Figure 13:
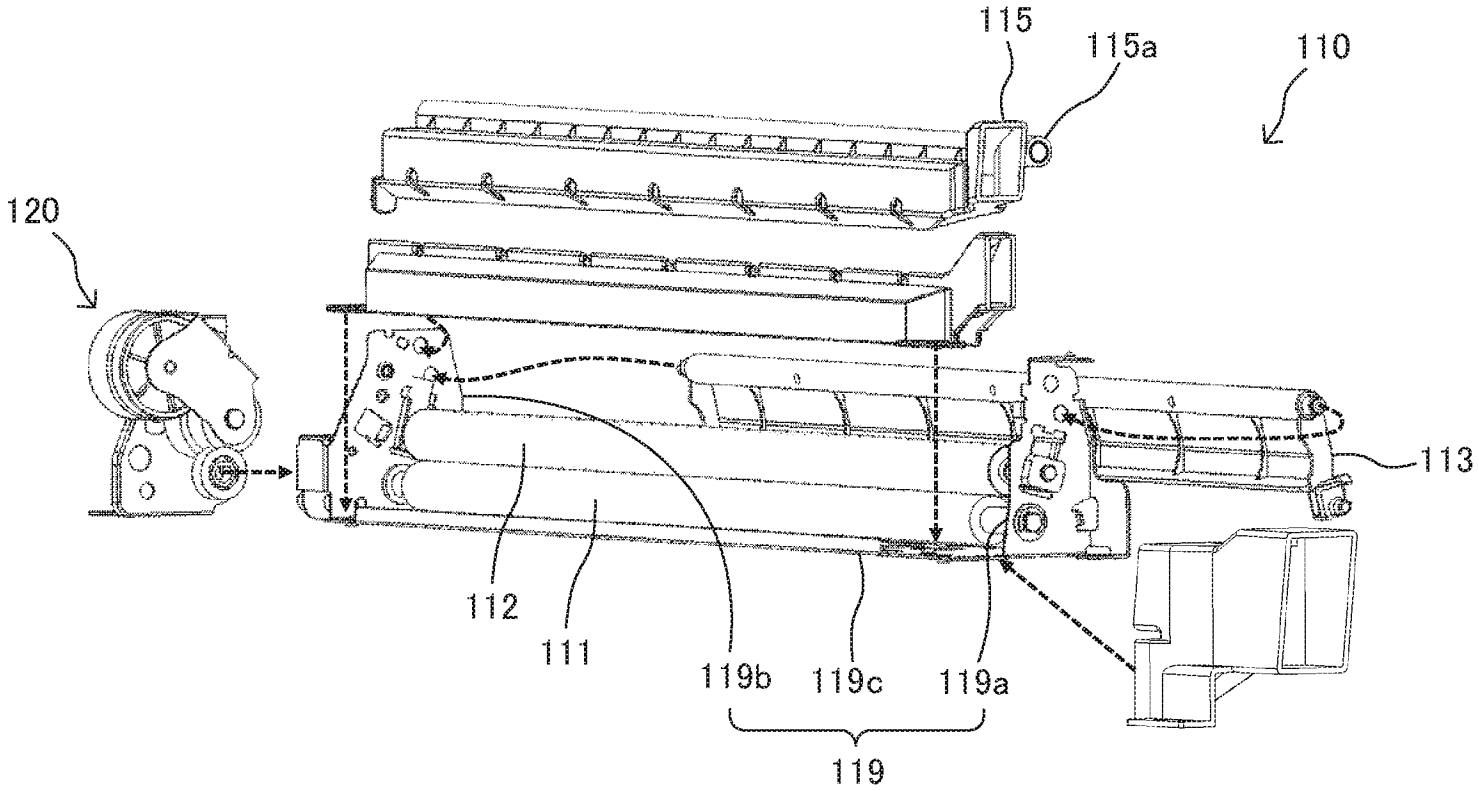
FIG. 13 is an exploded perspective view illustrating one portion of the conveying cooling unit.

FIG. 12 is a partial perspective view illustrating one end portion of the conveying cooling unit 110 in a longitudinal direction (an end portion of the conveying cooling unit 110 on the copier front side). FIG. 13 is an exploded perspective view illustrating one portion of the conveying cooling unit 110. The conveying cooling unit 110 includes a metal plate frame 119 including a front plate 119*a*, a rear plate 119*b*, and a bottom plate 119*c*. The lower nip guide 114 described above with reference to FIG. 4 is integrally formed with the metal plate frame 119.

The lower blower duct 116 is fixed to an upper surface of the bottom plate 119*c* of the metal plate frame 119.

Each of the drive roller 111 and the driven roller 112 is rotatable using a bearing disposed in the front plate 119*a* and a bearing disposed in the rear plate 119*b*.

A drive transmission unit 120 for transmitting a driving force to the drive roller 111 is fixed to the back of the rear plate 119*b* of the metal plate frame 119. In FIG. 12, a fixed shaft 117 is disposed above the driven roller 112. Although the fixed shaft 117 is omitted in FIG. 13 for the sake of convenience, the fixed shaft 117 is fixed to both of the front plate 119*a* and the rear plate 119*b* of the metal plate frame 119 so as to be laid across the front plate 119*a* and the rear plate 119*b*.

The upper blower duct 115 is rotatably held by the fixed shaft 117 in a state in which the fixed shaft 117 is inserted into the slide bearing 115*a* disposed in each of both end portions of the upper blower duct 115 in the longitudinal direction. A torsional spring 118 as an urging member is also held by the fixed shaft 117. The torsional spring 118 urges the upper blower duct 115 toward the lower blower duct 116 as indicated by an arrow illustrated in FIG. 12.

Figure 14:
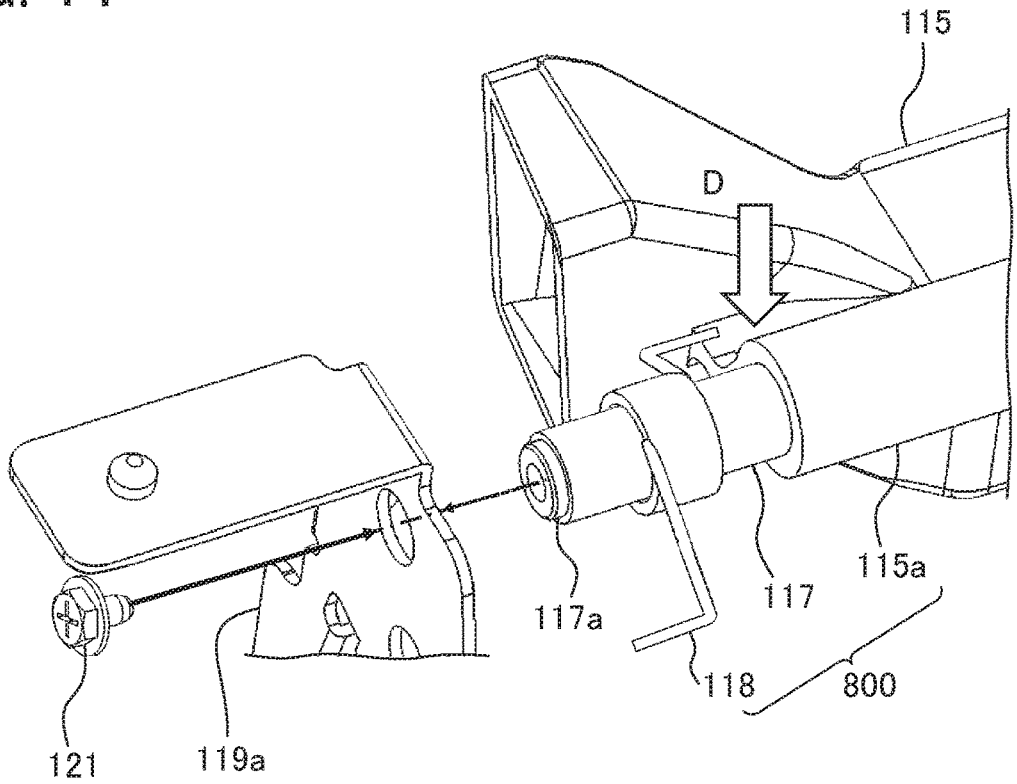
FIG. 14 is a perspective view partially illustrating a front plate of the conveying cooling unit and the periphery of the front plate.
Figure 15:
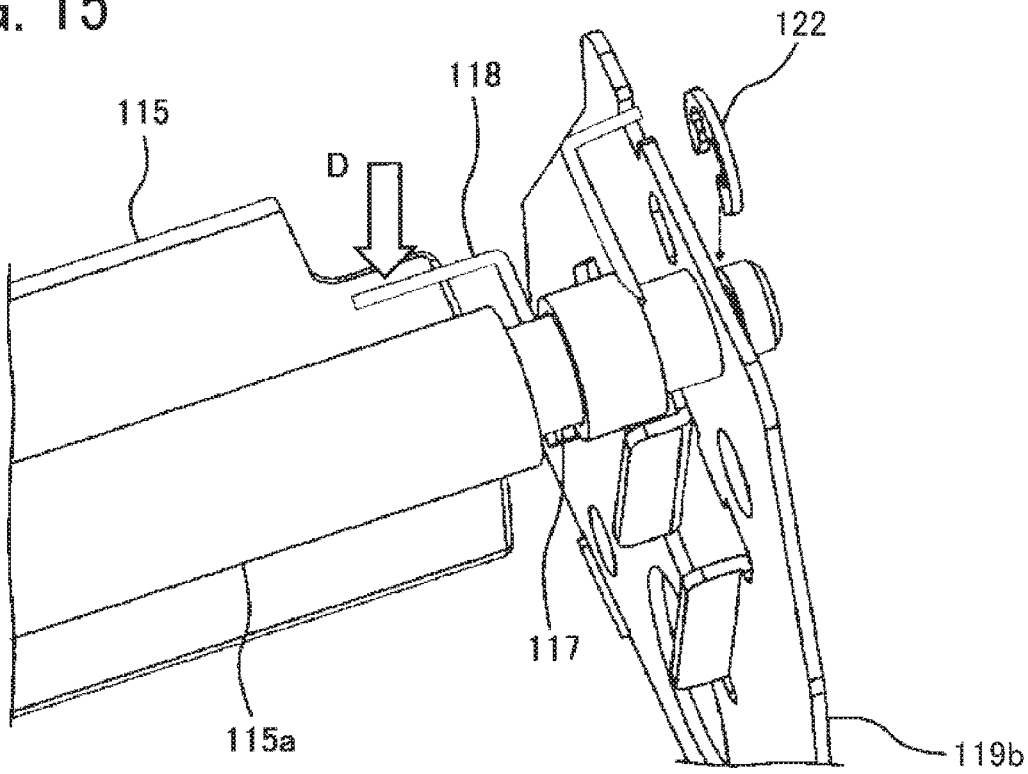
FIG. 15 is a perspective view partially illustrating a rear plate of the conveying cooling unit and the periphery of the rear plate.

FIG. 14 is a perspective view partially illustrating the front plate 119*a* and the periphery of the front plate 119*a*. FIG. 15 is a perspective view partially illustrating the rear plate 119*b* and the periphery of the rear plate 119*b*. As illustrated in FIG. 14, one end of the fixed shaft 117 in a longitudinal direction has a small end 117*a* having an outer diameter smaller than an outer diameter of the fixed shaft 117. The outer diameter of the small end 117*a* is slightly smaller than an inner diameter of a through hole formed on the front plate 119*a*. On an inner circumferential surface of the small end 117*a*, a female screw is cut. The outer diameter of the fixed shaft 117 is greater than the inner diameter of the through hole on the front plate 19*a*.

One end of the fixed shaft 117 is fixed to the front plate 119*a* with a male screw 121 that is inserted into the small end 117*a* from an outer side of the front plate 119*a* in a state in which the small end 117*a* is inserted in the front plate 119*a*.

As for the other end of the fixed shaft 117, as illustrated in FIG. 15, a guard ring 122 is fitted into a groove formed on a shaft end portion projecting outward relative to the rear plate 119*b*. Thus, a longitudinal movement of the fixed shaft 117 is regulated, and the fixed shaft 117 is fixed to both of the front plate 119*a* and the rear plate 119*b* without slipping through an area between the front plate 119*a* and the rear plate 119*b*. Moreover, the torsional spring 118 held in each of both end portions of the fixed shaft 117 in the longitudinal direction urges the upper blower duct 115 toward a direction indicated by an arrow D illustrated in FIG. 15. The direction D represents a direction toward the lower blower duct 116.

Each of the both end portions of the upper blower duct 115 in a longitudinal direction is urged toward the direction D. Accordingly, if a sheet P contacts the upper blower duct 115 during sheet feeding, vibration of the upper blower duct 115 in a direction away from the lower blower duct 116 due to a conveyance force of the sheet P can be prevented.

In the conveying cooling unit 110, the slide bearing 115*a* of the upper blower duct 115, the fixed shaft 117, and the torsional spring 118 form a moving mechanism 800 that renders the upper blower duct 115 move between the opposite position and the retracted position.

In the present embodiment, the moving mechanism 800 is configured such that the upper blower duct 115 can be passively moved between the opposite position and the retracted position by manual operation performed by a user. However, the moving mechanism 800 is not limited thereto. For example, a moving mechanism may be configured such that a driving unit such as a motor for rotating the upper blower duct 115 about the fixed shaft 117 is disposed. In such a case, the upper blower duct 115 can be actively moved between an opposite position and a retracted position by the driving unit.

Figure 16:
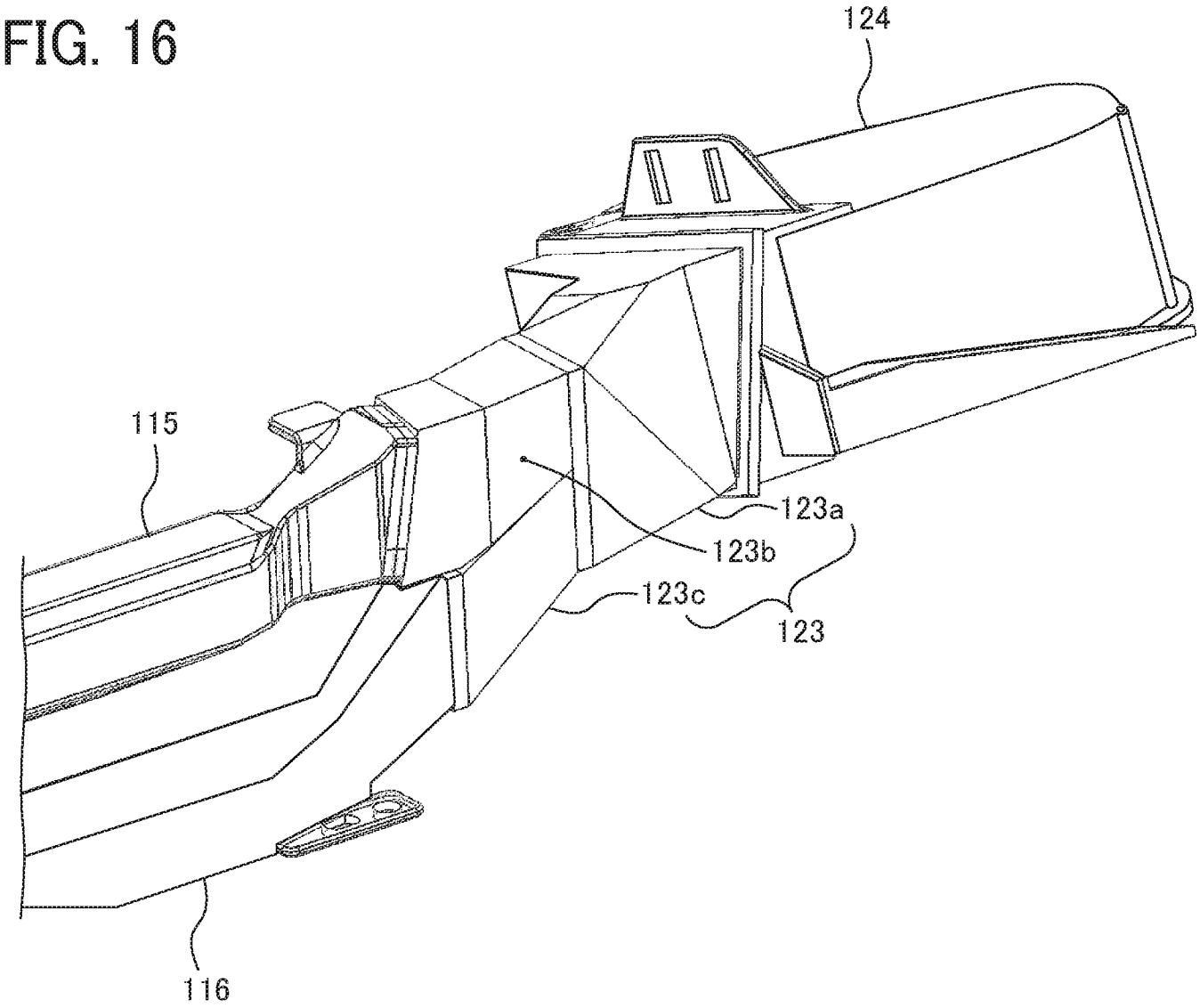
FIG. 16 is a perspective view illustrating one-end portions of the upper blower duct and a lower blower duct in a longitudinal direction, a connecting tube, and a fan.

FIG. 16 is a perspective view illustrating one end portions of the upper blower duct 115 and the lower blower duct 116 in a longitudinal direction, a connecting tube 123, and an air supply fan 124. The conveying cooling unit 110 includes the connecting tube 123 and the air supply fan 124.

The connecting tube 123 includes a receiving potion 123*a*, a first communicating portion 123*b*, and a second communicating portion 123*c*. The receiving potion 123*a* is fixed to an exhaust outlet of the air supply fan 124. Thus, an exhaust port of the air supply fan 124 including a sirocco fan communicates with a receiving port of the receiving potion 123*a* of the connecting tube 123, and exhaust air from the air supply fan 124 is send to the receiving potion 123*a* of the connecting tube 123.

Each of the first communicating portion 123*b* and the second communicating portion 123*c* of the connecting tube 123 diverges from the receiving potion 123*a*. Accordingly, airflow to the receiving potion 123*a* is divided into airflow entering the first communicating portion 123*b* and airflow entering the second communicating portion 123*c*.

The first communicating portion 123*b* of the connecting tube 123 is connected to one end of the upper blower duct 115, so that the upper blower duct 115 and the first communicating portion 123*b* of the connecting tube 123 communicate with each other. The airflow having entered the first communicating portion 123*b* via the receiving potion 123*a* of the connecting tube 123 is sent inside the upper blower duct 115, and then sent out from an air supply port of the upper blower duct 115. That is, the conveying cooling unit 110 ejects air as a coolant from the air supply port of the upper blower duct 115 toward the sheet P as a recording medium.

The second communicating portion 123*c* of the connecting tube 123 is connected to one end of the lower blower duct 116, so that the lower blower duct 116 and the second communicating portion 123*c* of the connecting tube 123 communicate with each other. The airflow having entered the second communicating portion 123*c* via the receiving potion 123*a* of the connecting tube 123 is sent inside the lower blower duct 116, and then sent out from an air supply port of the lower blower duct 116. That is, the conveying cooling unit 110 ejects air as a coolant from the air supply port of the lower blower duct 116 toward a sheet P as a recording medium.

With such a configuration, the single air supply fan 124 (a single blower source) sends airflow to both directions of the upper blower duct 115 and the lower blower duct 116. Hence, the apparatus can be made at lower cost and more compact than an apparatus including two blower sources.

Figure 17:
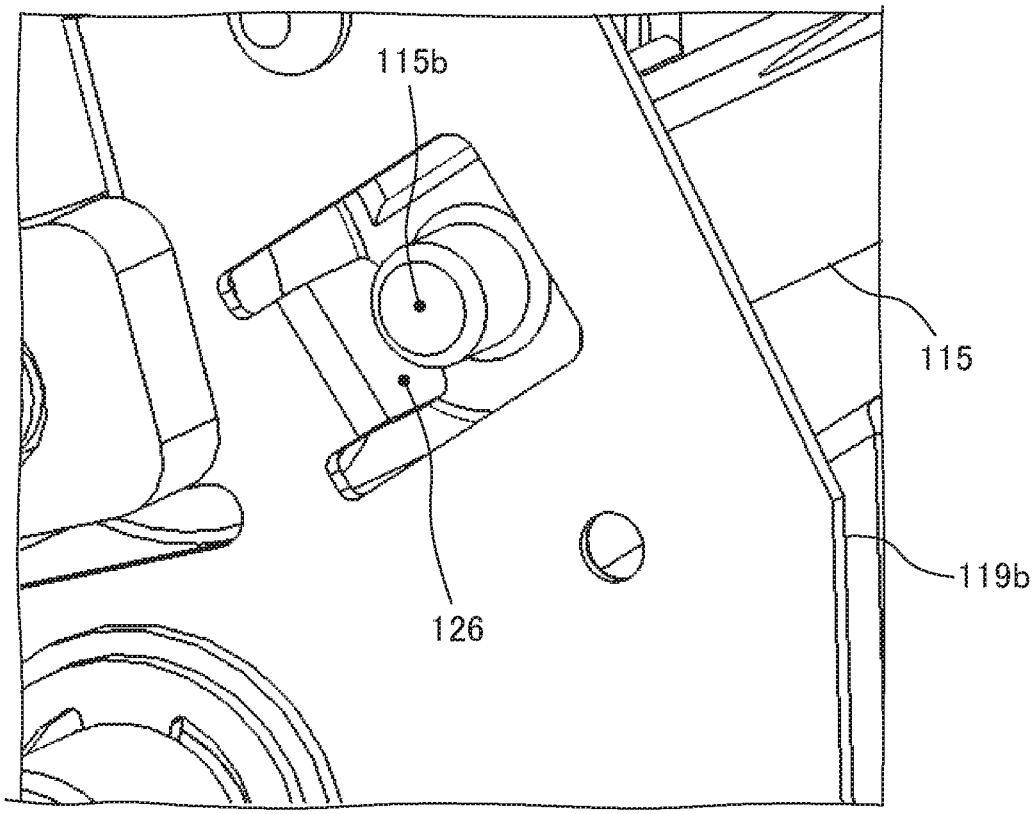
FIG. 17 is a partial perspective view illustrating the other end portion of the upper blower duct in the longitudinal direction and one portion of the rear plate.

FIG. 17 is a partial perspective view illustrating the other end portion of the upper blower duct 115 in a longitudinal direction and one portion of the rear plate 119*b*. A positioning member 126 is fixed to the rear plate 119*b*. Similarly, a positioning member 126 is fixed to the front plate 119*a* although the front plate 119*a* is not illustrated in FIG. 17. A cylindrical boss 115*b* is disposed in a protruding manner on the other end surface of the upper blower duct 115. Similarly, a boss 115*b* is disposed in a protruding manner on one end surface (not illustrated in FIG. 17) of the upper blower duct 115 in a longitudinal direction.

Figure 18:
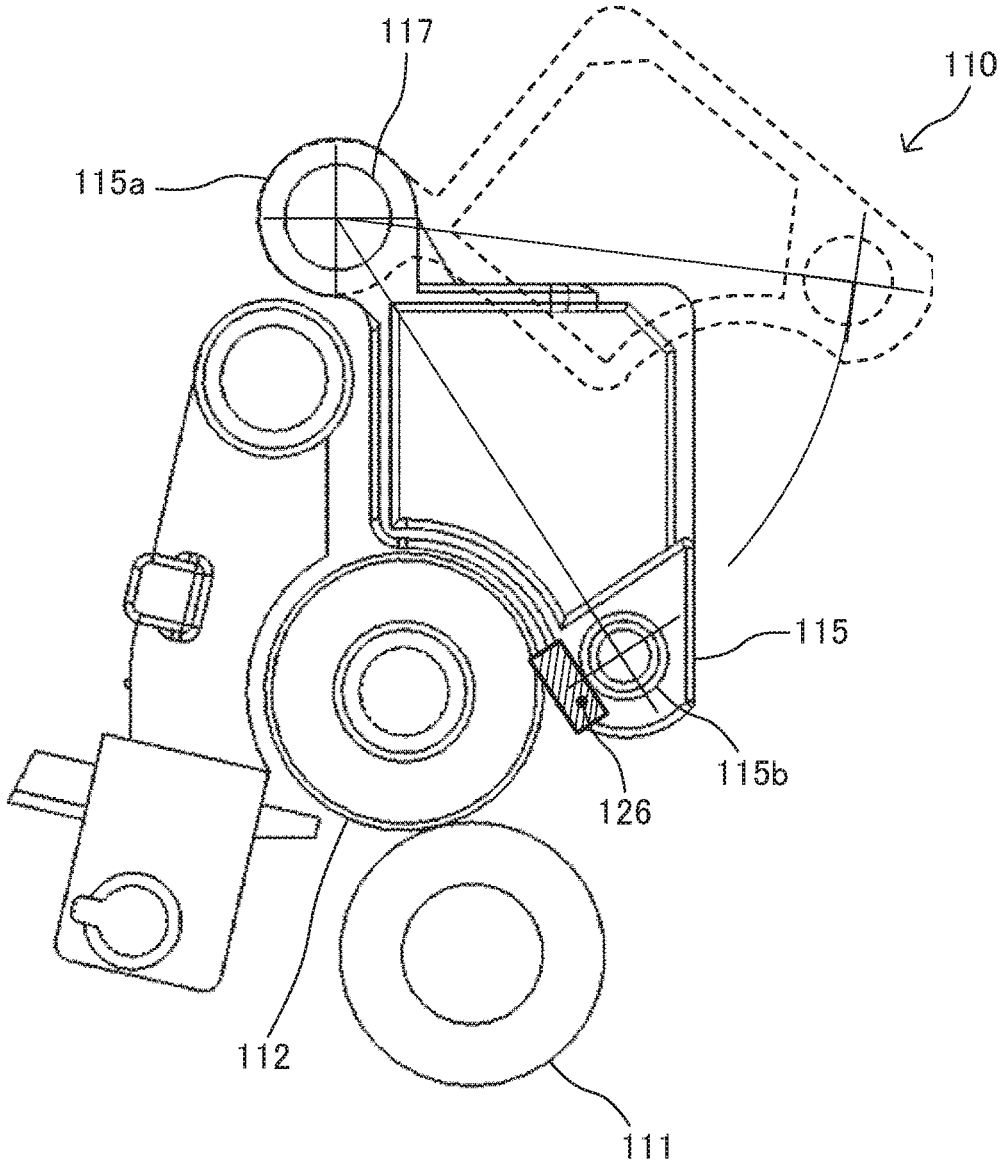
FIG. 18 is a sectional view illustrating the upper blower duct moved to an opposite position from the retracted position, and the periphery of the upper blower duct.

As for the upper blower duct 115 urged in the direction D illustrated in FIGS. 14 and 15 by the torsional spring 118, the boss 115*b* contacts the positioning member 126 as illustrated in FIG. 18. Accordingly, a position of the upper blower duct 115 is set with respect to the metal plate frame 119. Such positioning of the upper blower duct 115 renders the upper blower duct 115, which is movable between the opposite position (the position opposite the post-transfer conveyance path 104) for sending of the air toward a sheet P and the retracted position, adapt a normal arrangement in the opposite position. Thus, degradation in cooling performance due to a change in arrangement of the upper blower duct 115 in the opposite position can be prevented.

Figure 19:
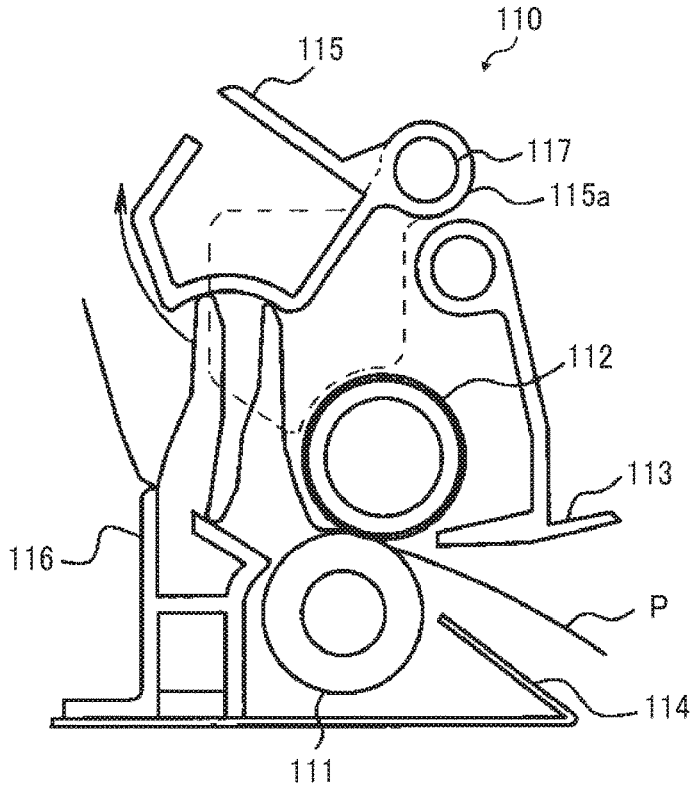
FIG. 19 is a cross-sectional view illustrating a case where a position of the upper blower duct is set.

In the conveying cooling unit 110, a sheet P may be complicatedly bent due to a jam as illustrated in FIG. 19. In such a case, the bent sheet P causes the upper blower duct 115 to be rotated clockwise in FIG. 19 about the fixed shaft 117 of a hinge, so that the upper blower duct 115 is spontaneously retracted from the opposite position indicated by a dotted line illustrated in FIG. 19. Such retraction of the upper blower duct 115 can prevent damage to the apparatus due to the sheet P densely jammed between the upper blower duct 115 and the lower blower duct 116.

A user pinches and pulls a leading end of the sheet P illustrated in FIG. 19, so that the sheet P can be readily removed from under the upper blower duct 115. At the same time, the upper blower duct 115 is urged by an urging force of the torsional spring 118, thereby automatically setting the upper blower duct 115 in the normal opposite position.

Figure 20:
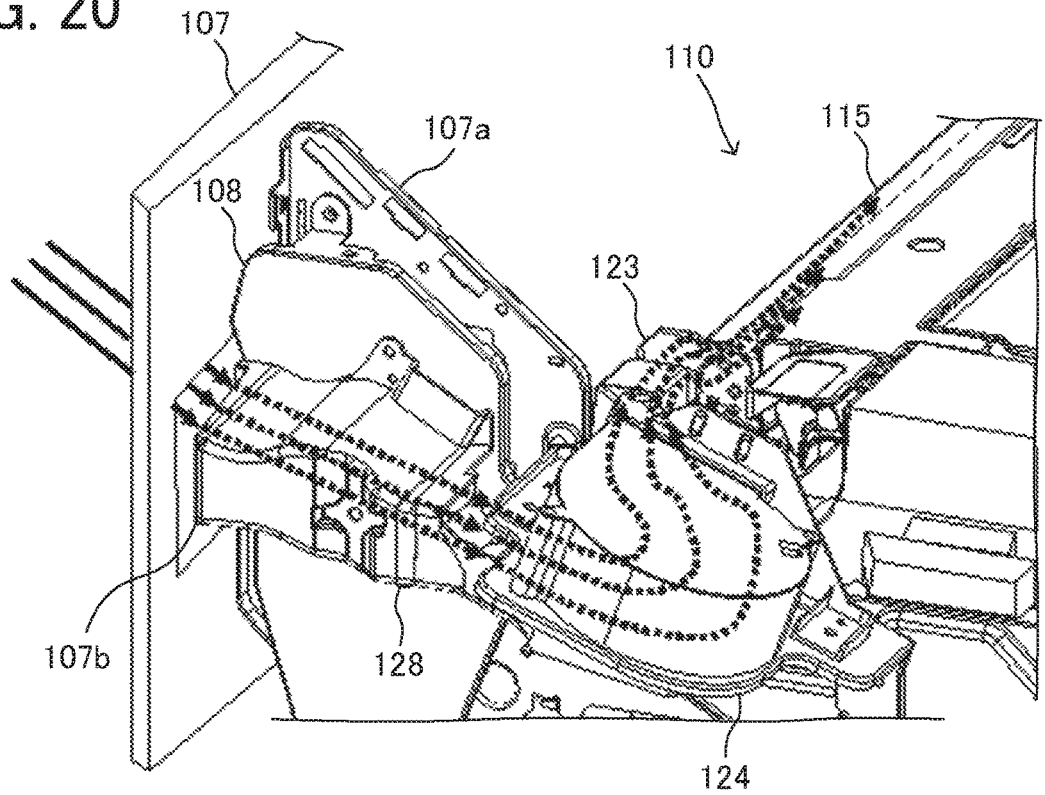
FIG. 20 is a partial perspective view illustrating a frame of a sheet conveyance unit that can be pulled out from the printer, and one portion of the conveying cooling unit.

FIG. 20 is a partial perspective view illustrating one portion of the conveying cooling unit 110 and a frame 107 of the sheet conveyance unit 100 which can be pulled out from the printer 1. The frame 107 includes an intake port 107*b* for taking outside air therein. Moreover, the frame 107 includes a fan holding portion 107*a* disposed in a protruding manner. The air supply fan 124 and an intake duct 128 of the conveying cooling unit 110 are fixed to the fan holding portion 107*a* via a holder 108.

One end of the intake duct 128 is connected to an intake unit of the air supply fan 124. The other end of the intake duct 128 has an opening opposite the intake port 107*b* of the frame 107.

Since the intake duct 128 is attached to the frame 107 of the sheet conveyance unit 100 which can be pulled out from the printer 1, the intake duct 128 moves in a front-rear direction of the copier 1000 by following pullout and insertion of the sheet conveyance unit 100.

During a print job performed by the printer 1, the sheet conveyance unit 100 is being inserted inside the printer 1. If the air supply fan 124 is rotated in such a state, a suction force is generated in the intake unit of the air supply fan 124. With the suction force, the outside air is sucked inside the intake port 107*b* of the frame 107 as illustrated by a dotted line in FIG. 20, and introduced inside the air supply fan 124 via the intake duct 128. Then, the air is exhausted from an exhaust outlet of the air supply fan 124, and sent inside the upper blower duct or the lower blower duct via the connecting tube 123.

The fixing device 106 illustrated in FIG. 2 or the conveying cooling unit 110 may need maintenance work. In such a case, after the sheet conveyance unit 100 illustrated in FIG. 2 is pulled out from the printer 1, the fixing device 106 or the conveying cooling unit 110 is removed from the sheet conveyance unit 100. Herein, the air supply fan 124 and the intake duct 128 remain fixed to the frame 107 of the sheet conveyance unit 100, and are not removed from the sheet conveyance unit 100. By contrast, the connecting tube 123 connected to the intake duct 128, and the conveying cooling unit 110 are integrally removed from the sheet conveyance unit 100.

Figure 21:
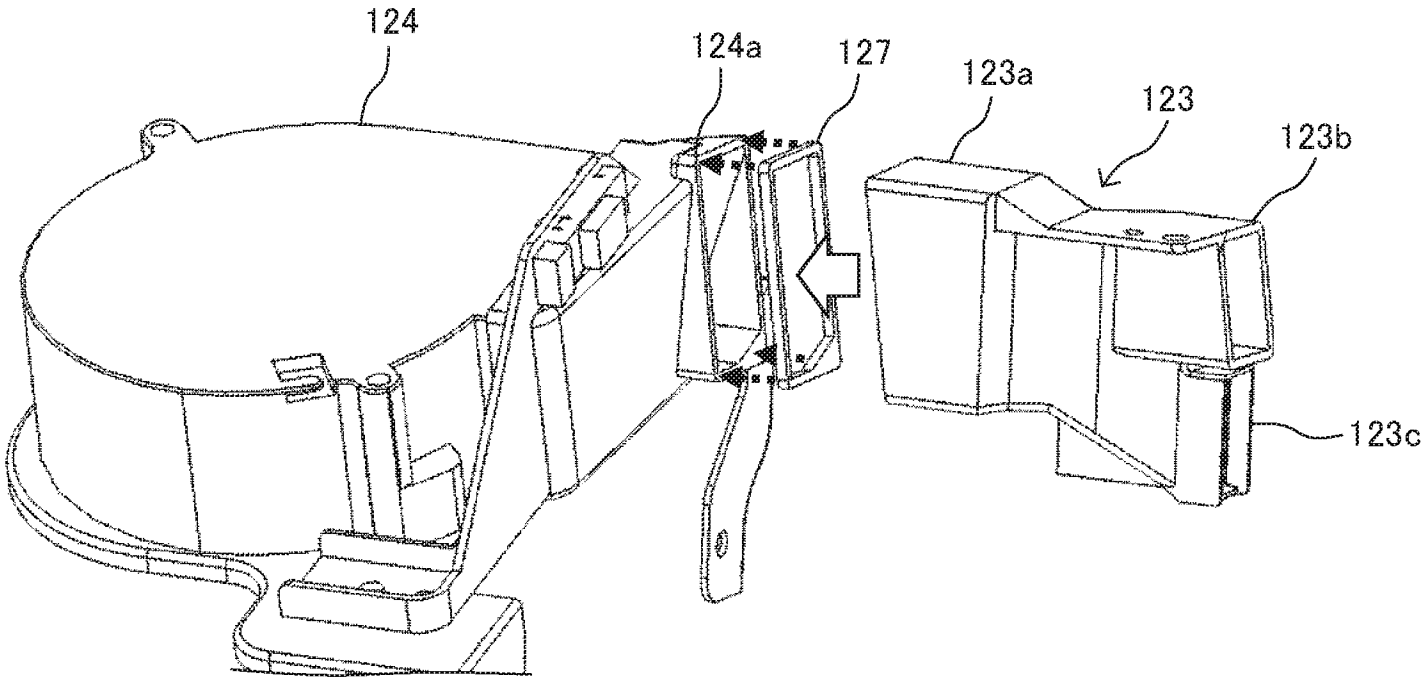
FIG. 21 is an exploded perspective view illustrating the air supply fan and the connecting tube.

FIG. 21 is an exploded perspective view illustrating the air supply fan 124 and the connecting tube 123. The air supply fan 124 has an exhaust portion 124*a*, and an elastic member 127 such as a sponge is attached to the periphery of an exhaust port in the exhaust portion 124*a*. The receiving potion 123*a* of the connecting tube 123 is connected to the exhaust portion 124*a* of the air supply fan 124 via the elastic member 127. The arrangement of the elastic member 127 between the receiving potion 123*a* and the exhaust portion 124*a* can enhance the seal of a connection portion between the receiving potion 123*a* and the exhaust portion 124*a*.

Figure 22:
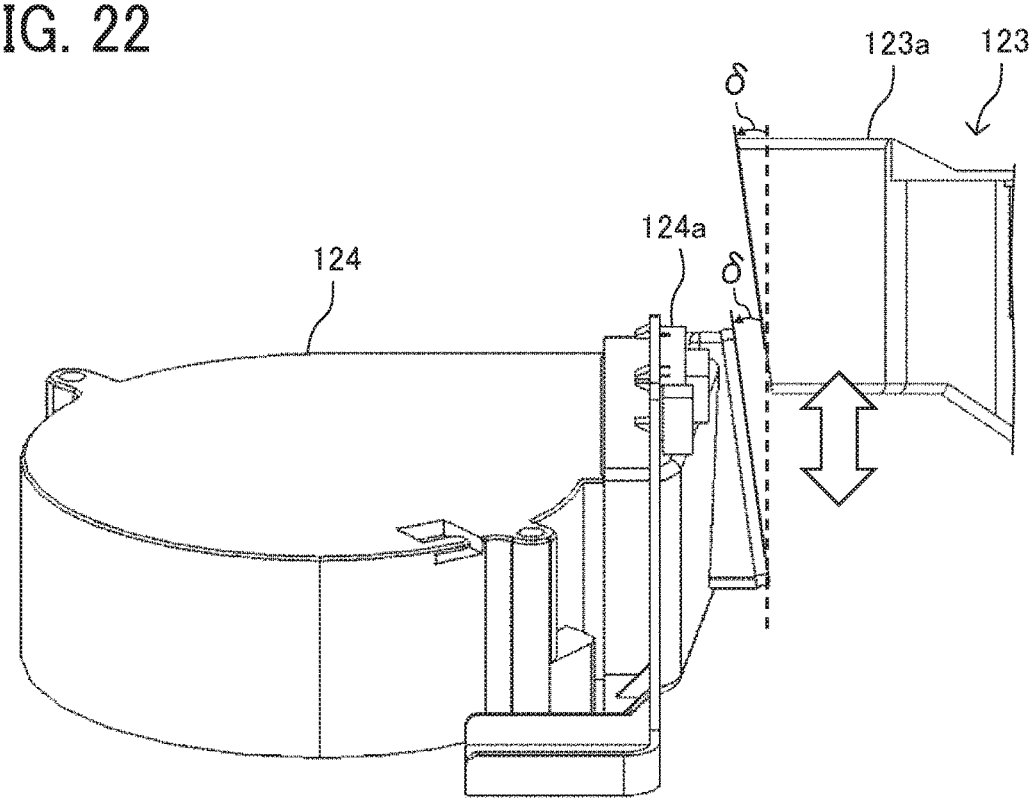
FIG. 22 is an exploded perspective view illustrating the air supply fan and a receiving portion of the connecting tube as seen from an angle different from the perspective view illustrated in FIG. 21.

FIG. 22 is an exploded perspective view illustrating the air supply fan 124 and the receiving potion 123*a* of the connecting tube 123 as seen from an angle different from the perspective view illustrated in FIG. 21. In FIG. 22, a dotted line indicates a detachment direction (hereinafter referred to as a unit detachment direction) of the fixing device 106 and the conveying cooling unit 110 with respect to the sheet conveyance unit 100.

As illustrated in FIG. 22, the receiving potion 123*a* of the connecting tube 123 has an end portion that is inclined to a unit detachment direction at an angle δ. Moreover, the exhaust portion 124*a* of the air supply fan 124 is inclined to the unit detachment direction with an angle δ. The arrangement of such inclination enables the connecting tube 123 connected to the exhaust portion 124*a* of the air supply fan 124 via the elastic member 127 to be readily separated from the exhaust portion 124*a*. Thus, the conveying cooling unit 110 can be smoothly removed from the sheet conveyance unit 100 without interfering with other members in a state in which the conveying cooling unit 110 remains attached to the fixing device 106.

Figure 23:
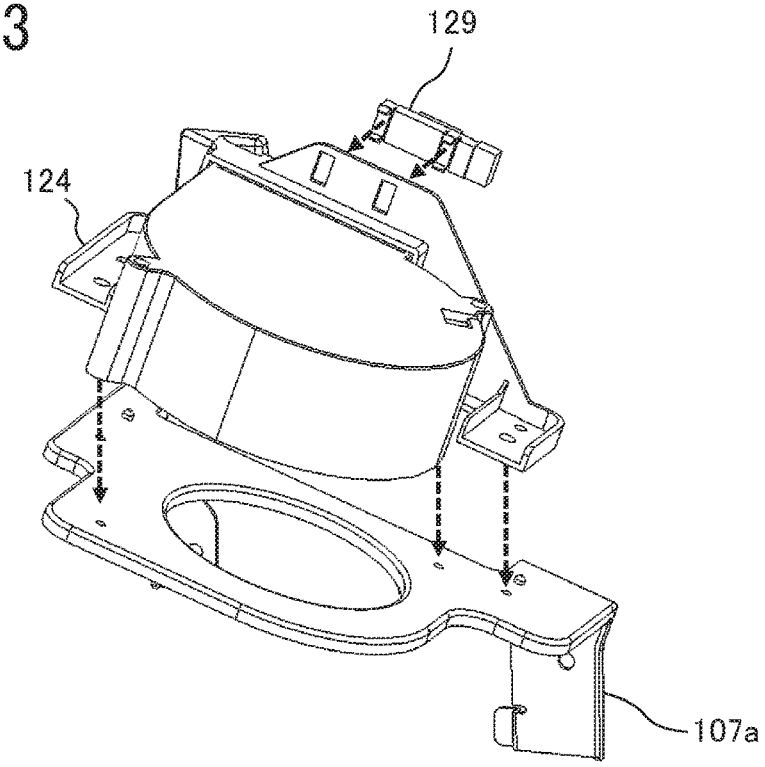
FIG. 23 is a perspective view illustrating the air supply fan and a fan holding portion.

FIG. 23 is a perspective view illustrating the air supply fan 124 and the fan holding portion 107*a*. As illustrated, an optical sensor 129 is attached to the air supply fan 124.

Figure 24:
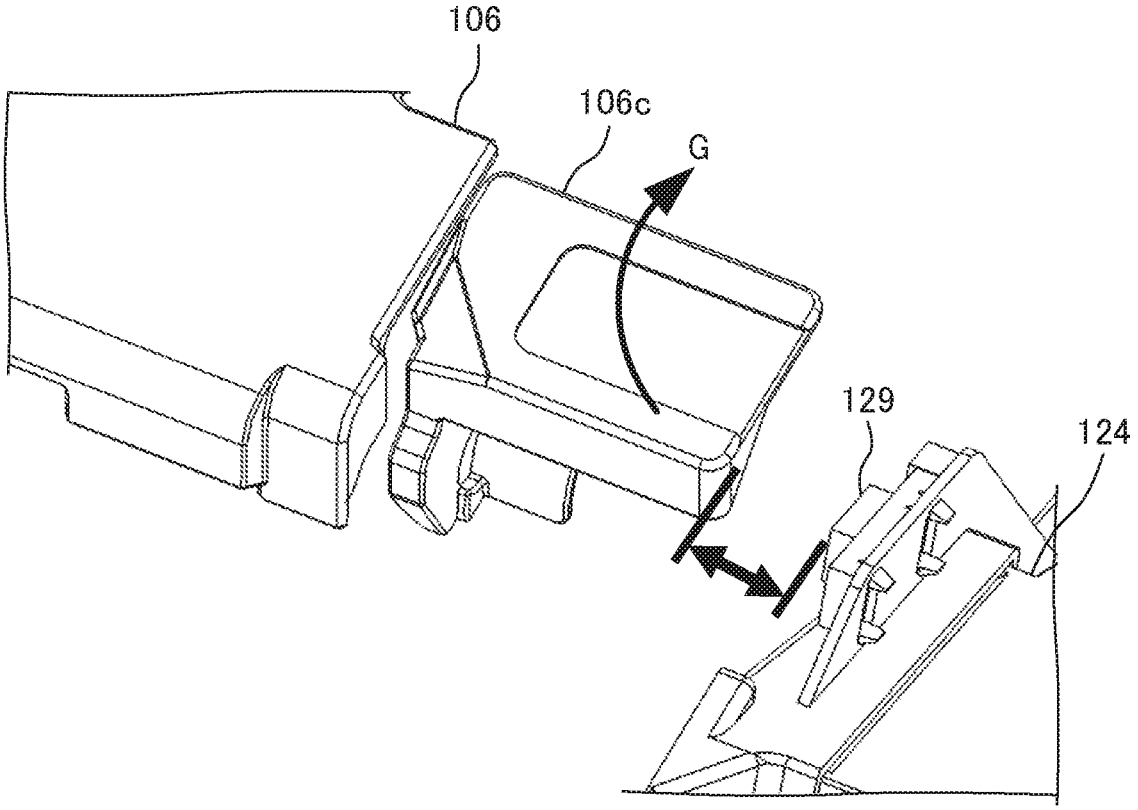
FIG. 24 is a partial perspective view illustrating one portion of the air supply fan and one end portion of the fixing device in a longitudinal direction.

FIG. 24 is a partial perspective view illustrating one portion of the air supply fan 124 and one end portion of the fixing device 106 in a longitudinal direction. A latch lever 106*c* is attached to one end of the fixing device 106. The latch lever 106*c* is used to engage the fixing device 106 with or disengage the fixing device 106 from the frame 107 of the sheet conveyance unit 100 of the printer 1. As illustrated in FIG. 24, when the latch lever 106*c* is in a position so as to extend in a substantially horizontal direction, the fixing device 106 is engaged with the frame 107 of the sheet conveyance unit 100. Moreover, the latch lever 106*c* is detected by the optical sensor 129 fixed to the air supply fan 124.

On the other hand, when the latch lever 106*c* is rotated in a direction indicated by an arrow G illustrated in FIG. 24 to a position so as to extend in a substantially vertical direction, the fixing device 106 is disengaged from the frame 107. Thus, the fixing device 106 can be removed from the frame 107 of the sheet conveyance unit 100. Moreover, when the latch lever 106*c* is retracted from a position opposite the optical sensor 129 fixed to the air supply fan 124, the optical sensor 129 stops detecting the latch lever 106*c*. Then, the optical sensor 129 transmits a non-detection signal to a controller. Upon receipt of the non-detection signal, the controller displays a message indicating that the fixing device 106 has been removed on the operation display 400, so that a print job based on a print command from a user is not executed.

Figure 25:
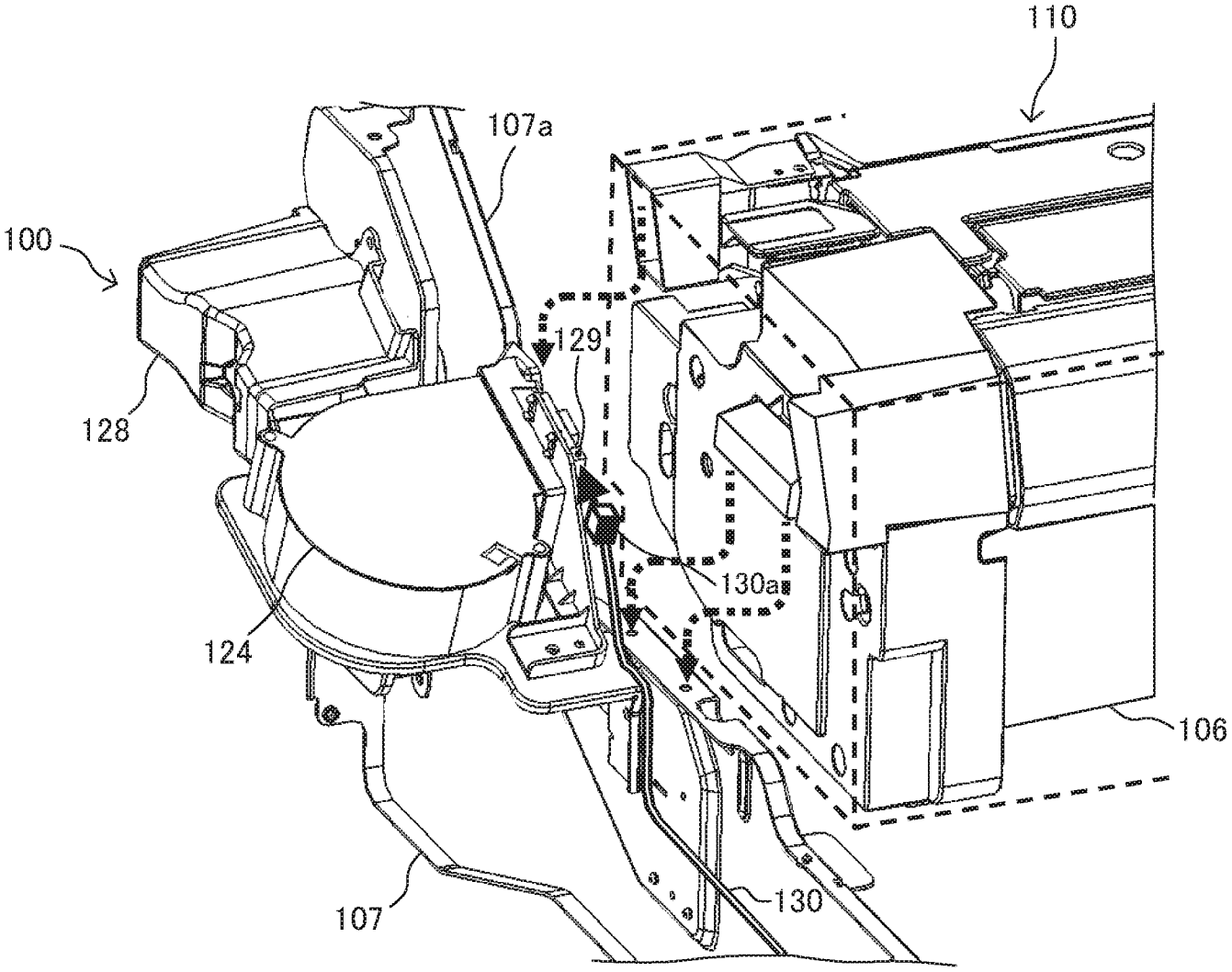
FIG. 25 is an exploded perspective view illustrating a front end portion of the sheet conveyance unit.

FIG. 25 is an exploded perspective view illustrating a front end portion of the sheet conveyance unit 100 of the printer 1. As indicated by a dotted arrow illustrated in FIG. 25, the fixing device 106 is set on the frame 107 of the sheet conveyance unit 100. At the same time, the conveying cooling unit 110 attached to the fixing device 106 is set on the frame 107.

The optical sensor 129 fixed to the air supply fan 124 is electrically connected to the controller via a harness 130. Unlike the copier, in a case in which the optical sensor 129 is fixed to the fixing device 106 or the conveying cooling unit 110, the following operation becomes necessary when the fixing device 106 is removed from the frame 107 of the sheet conveyance unit 100. In the operation, that is, a connector 130*a* of the harness 130 that needs to be fixed to the frame 107 is removed from the optical sensor 129 to separate the harness 130 from the optical sensor 129. On the other hand, in the copier, the optical sensor 129 is fixed to a member such as the air supply fan 124 fixed to the frame 107, so that the fixing device 106 and the conveying cooling unit 110 can be removed from the frame 107 without the aforementioned operation. Therefore, workability of removing the fixing device 106 and the conveying cooling unit 110 can be enhanced.

Although a transmission optical sensor is used as the optical sensor 129, a reflection optical sensor can be used. In such a case, the latch lever 106*c* includes a reflecting surface. Alternatively, a sensor that magnetically, electrically, or mechanically detects the latch lever 106*c* may be used, instead of the optical sensor 129.

Figure 26:
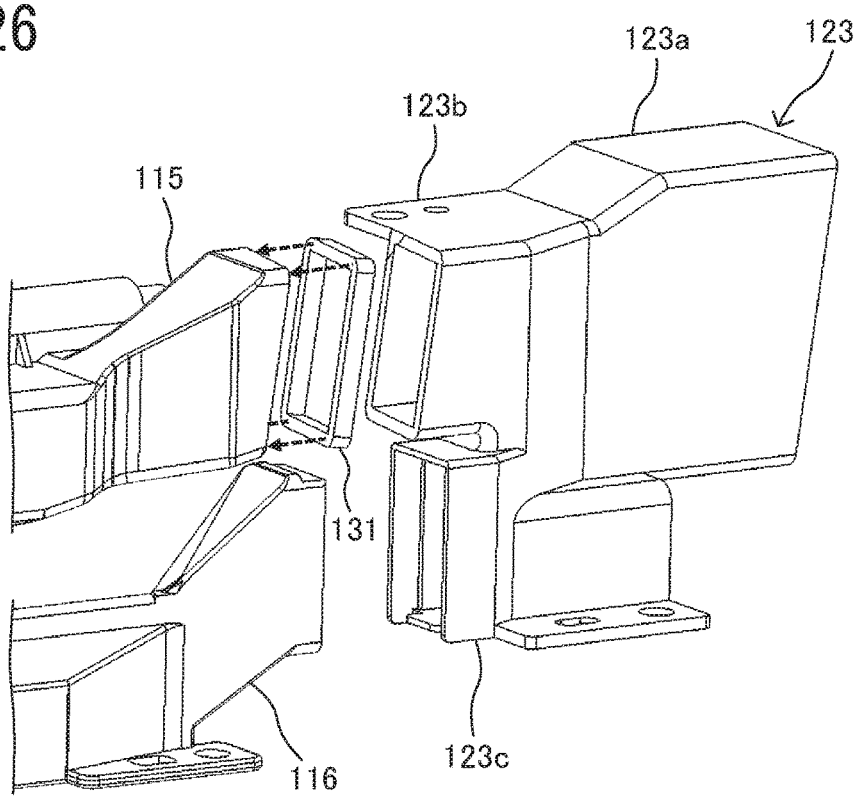
FIG. 26 is an exploded perspective view illustrating the connecting tube and one-end portions of the upper blower duct and the lower blower duct in a longitudinal direction.

FIG. 26 is an exploded perspective view illustrating the connecting tube 123 and one-end portions of the upper blower duct 115 and the lower blower duct 116 in a longitudinal direction. In the upper blower duct 115 as illustrated in FIG. 26, an elastic member 131 including a sponge is attached to the periphery of a communication port that communicates with the first communicating portion 123*b* of the connecting tube 123. The upper blower duct 115 is connected to the first communicating portion 123*b* of the connecting tube 123 via the elastic member 131.

Each of the lower blower duct 116 and the connecting tube 123 is fixed to the bottom plate 119*c* of the metal plate frame 119 of the conveying cooling unit 110, and does not move. On the other hand, the upper blower duct 115 rotates about the fixed shaft 117. When a position of the upper blower duct 115 is set with respect to the metal plate frame 119 as described above, the upper blower duct 115 is connected to the first communicating portion 123*b* of the connecting tube 123 via the elastic member 131. Such connection can enhance the seal of the joint between the upper blower duct 115 and the first communicating portion 123*b*.

The elastic member 131 may be fixed to the first communicating portion 123*b* of the connecting tube 123, instead of the fixation of the elastic member 131 to the upper blower duct 115. Alternatively, the elastic member 131 may be fixed to both of the upper blower duct 115 and the first communicating portion 123*b*.

Figure 27:
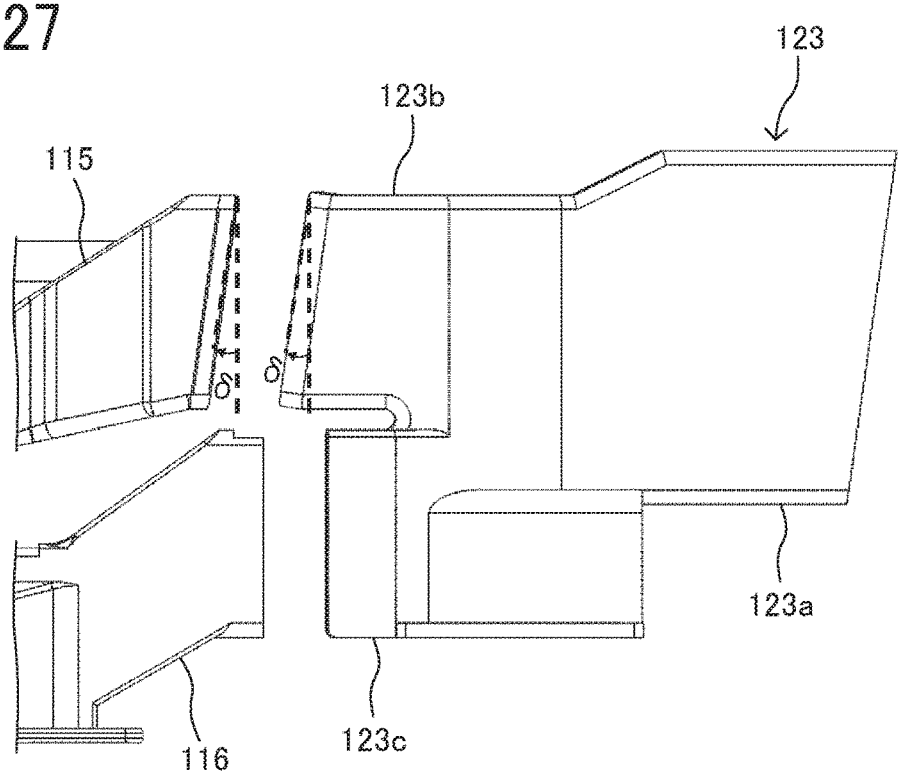
FIG. 27 is a side view illustrating the connecting tube and one-end portions of the upper blower duct and the lower blower duct in a longitudinal direction as seen from the left side of the copier.

FIG. 27 is a side view illustrating the connecting tube 123 and one-end portions of the upper blower duct 115 and the lower blower duct 116 in the longitudinal direction as seen from the left side of the copier. In FIG. 27, a dotted line extends in a vertical direction. An end of the upper blower duct 115 on the side connected to the first communicating portion 123*b* moves in a vertical direction with rotation of the upper blower duct 115 about the fixed shaft 117. The end of the upper blower duct 115 is inclined to the vertical direction at an angle δ. An end of the first communicating portion 123*b* on the side connected to the upper blower duct 115 is inclined to the vertical direction at an angle δ. The arrangement of such inclination enables the upper blower duct 115 to be smoothly connected to the first communicating portion 123*b* when the upper blower duct 115 retracted to the retracted position is urged to the opposite position by an urging force of the torsional spring 118 to set a position of the upper blower duct 115.

Figure 28:
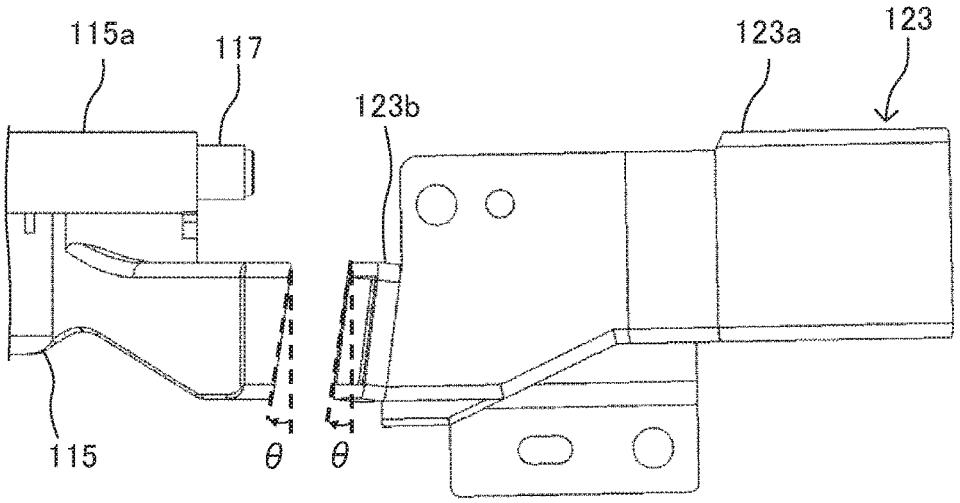
FIG. 28 is a plan view illustrating the connecting tube and one end portion of the upper blower duct in the longitudinal direction.

FIG. 28 is a plan view illustrating the connecting tube 123 and one end portion of the upper blower duct 115 in a longitudinal direction. In FIG. 28, a dotted line extends in a front-read direction of the copier. As illustrated in FIG. 28, an end of the upper blower duct 115 on the side connected to the first communicating portion 123*b* is inclined to the front-rear direction of the copier at an angle θ. Moreover, an end of the first communicating portion 123*b* on the side connected to upper blower duct 115 is inclined to the front-rear direction of the copier at an angle θ.

Figure 29:
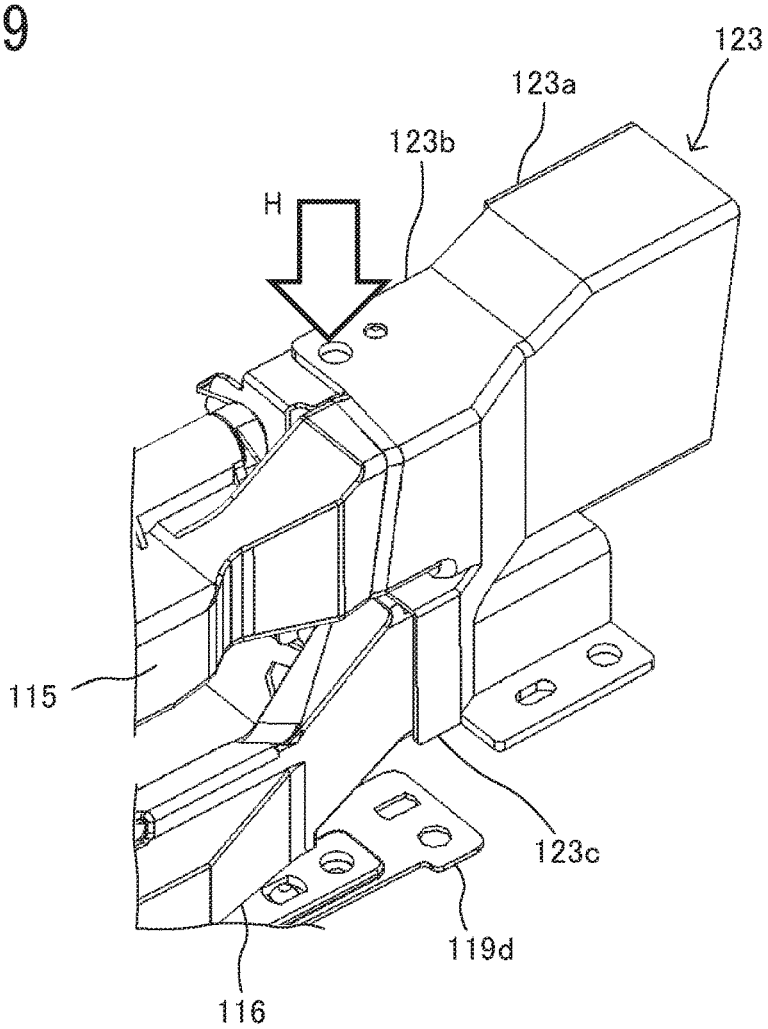
FIG. 29 is a perspective view illustrating the connecting tube, one end portion of the upper blower duct in the longitudinal direction, and one end portion of the lower blower duct that is in the longitudinal direction and fixed to a receiving rack of a metal plate frame.

FIG. 29 is a perspective view illustrating the connecting tube 123, one end portion of the upper blower duct 115 in a longitudinal direction, and one end portion of the lower blower duct 116 fixed to a receiving rack 119*d* of the metal plate frame 119 in the longitudinal direction. The lower blower duct 116 is fixed with an element such as a screw in a state in which the lower blower duct 116 is pressed against the receiving rack 119*d* of the metal plate frame 119 of the conveying cooling unit 110 in a direction indicated by an arrow H illustrated in FIG. 29. The connecting tube 123 is fixed with an element such as a screw in a state in which the connecting tube 123 is pressed against the metal plate frame 119 in the direction H.

Since the connecting tube 123 and the lower blower duct 116 are fixed to the metal plate frame 119 so as not to move, engagement of the connecting tube 123 with the lower blower duct 116 can maintain high sealed property without interposition of an elastic member.

Figure 30:
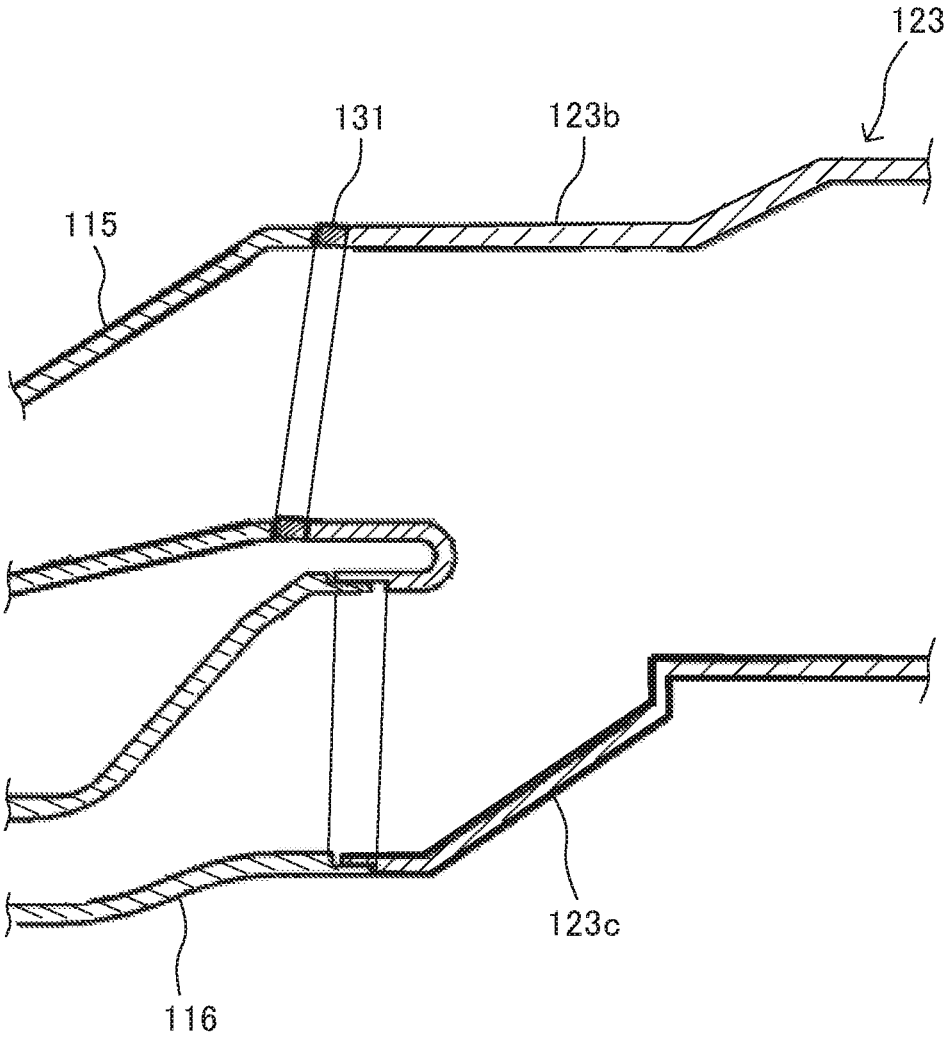
FIG. 30 is a longitudinal sectional view illustrating connection portions in which the upper blower duct and the lower blower duct are connected to the connecting tube.

FIG. 30 is a longitudinal sectional view illustrating connection portions in which the upper blower duct 115 and the lower blower duct 116 are connected to the connecting tube 123. As illustrated in FIG. 30, an end portion of the lower blower duct 116 on the side connected to the second communicating portion 123*c* of the connecting tube 123 has a step. An end portion of the second communicating portion 123*c* on the side connected to the lower blower duct 116 has a step. In a state in which the lower blower duct 116 or the connecting tube 123 is fixed to the metal plate frame 119, the lower blower duct 116 and the second communicating portion 123*c* are fitted such that the step of the end portion of the lower blower duct 116 and the step of the end portion of the second communicating portion 123*c* are engaged as illustrated in FIG. 30.

When the connecting tube 123 is to be removed from the metal plate frame 119 for operation such as maintenance work, the connecting tube 123 released from fixation can be simply lifted from the metal plate frame 119 without operation for moving the connecting tube 123 in a duct longitudinal direction. Accordingly, workability of removal of the connecting tube 123 can be enhanced.

Moreover, when the lower blower duct 116 is to be removed from the metal plate frame 119 in a state in which the connecting tube 123 is removed, the upper blower duct 115 is retracted to the retracted position. Such retraction of the upper blower duct 115 enables the lower blower duct 116 to be readily removed without disturbance by the upper blower duct 115.

Figure 31:
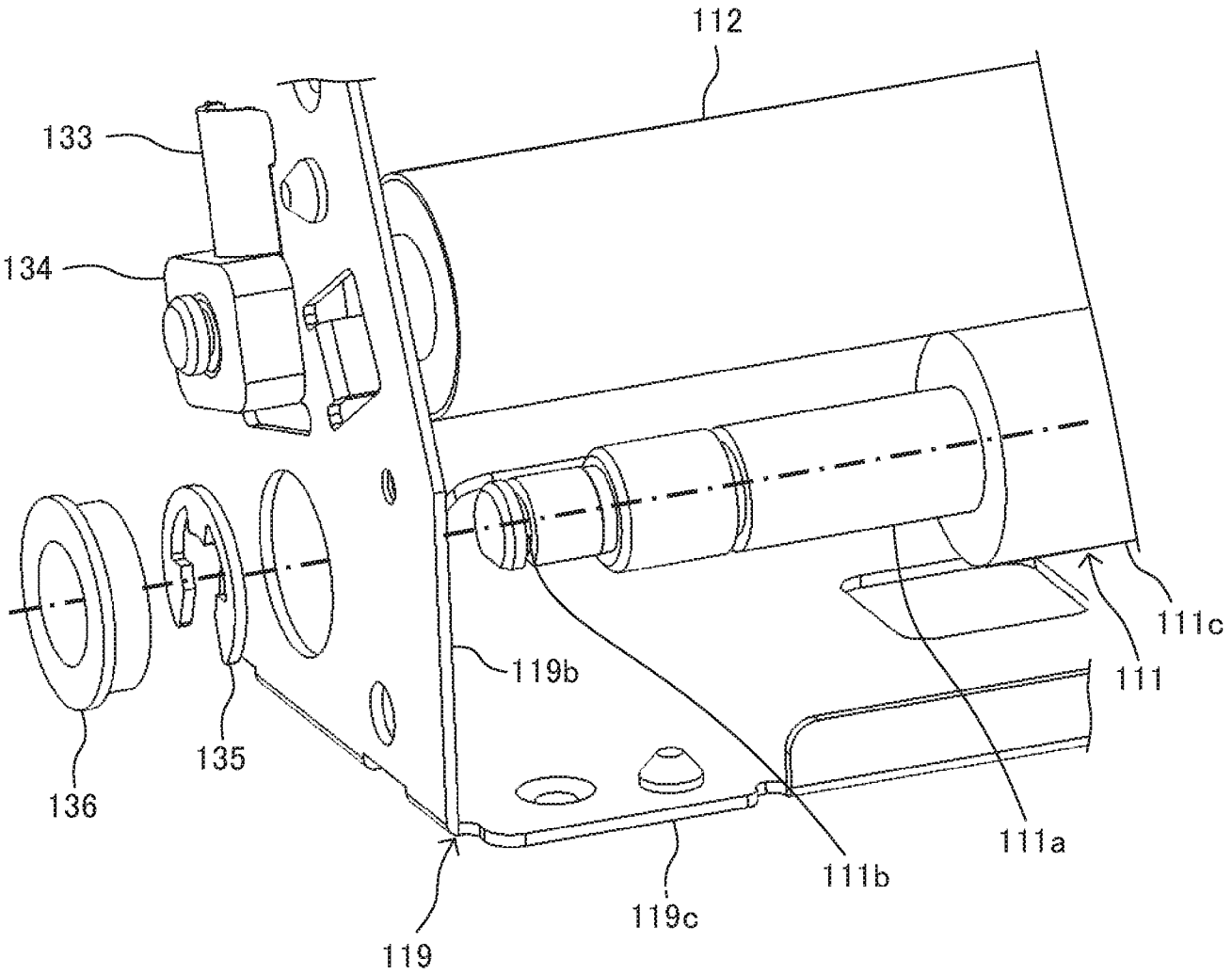
FIG. 31 is an exploded perspective view illustrating one portion of the conveying cooling unit.

FIG. 31 is an exploded perspective view illustrating one portion of the conveying cooling unit 110. The drive roller 111 of the conveying cooling unit 110 has a roller 111*c* that is pressed into a shaft member 111*a*. An end portion of the shaft member 111*a* has a shaft groove 111*b*. A guard ring 135 is fitted into the shaft groove 111*b* in a state in which the end portion of the shaft member 111*a* is inserted into a bearing 136 fixed to the rear plate 119*b* of the metal plate frame 119. Thus, the end portion of the shaft member 111*a* can be rotatably provided. Similarly, the other end portion of the shaft member 111*a* can be rotatably provided. Hence, the drive roller 111 does not slip through an area between the front plate 119*a* and the rear plate 119*b* of the metal plate frame 119. In such a state, the drive transmission unit 120 transmits a driving force received from a motor to the drive roller 111 to rotate the drive roller 111, and the drive roller 111 contacts the driven roller 112 to form a nip. Herein, the driven roller 112 is pressed toward the drive roller 111 by a bearing 134 pressed by a compression spring 133.

Figure 32:
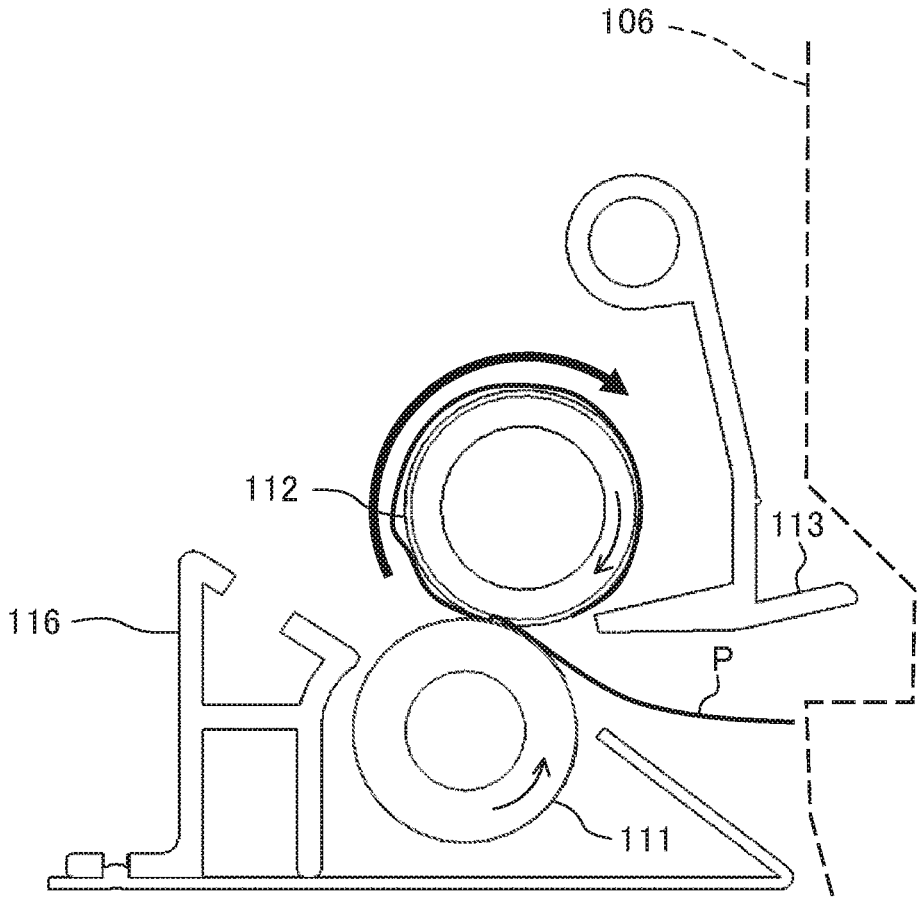
FIG. 32 is a diagram illustrating winding of a sheet around a driven roller.

FIG. 32 is a diagram illustrating winding of a sheet P around the driven roller 112. Since the driven roller 112 is disposed near the downstream side of the fixing device 106, the driven roller 112 is liable to receive heat of the fixing device 106. A sheet P not only immediately after heated at high temperature but also before cooled undergoes a fixing process. As a result, temperature of the driven roller 112 increases more easily, and the sheet P having good surface smoothness may be wound around the driven roller 112 when the sheet P enters a nip between the driven roller 112 and the drive roller 111. Particularly, if the sheet P having passed a fixing nip of the fixing device 106 is curled by heat or nip pressure, the sheet P wound around the driven roller 112 as illustrated in FIG. 32 may be rotated with rotation of the driven roller 112.

Figure 33:
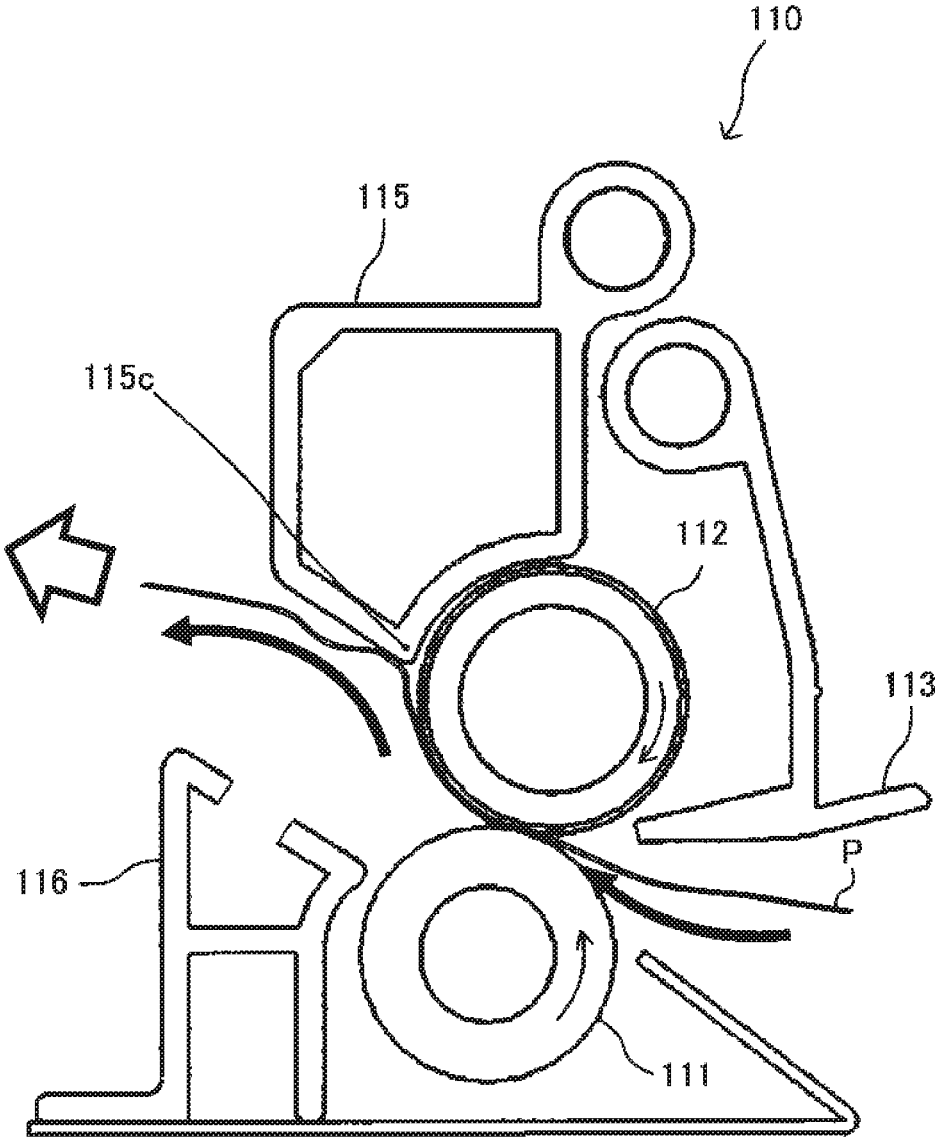
FIG. 33 is a diagram illustrating behavior of a sheet inside the conveying cooling unit.

FIG. 33 is a diagram illustrating behavior of a sheet P inside the conveying cooling unit 110 of the copier. In the conveying cooling unit 110, the upper blower duct 115 has a shape that is curved along a curved surface of the driven roller 112 as a conveyance roller for applying a conveyance force to the sheet P near the upper blower duct 115. Such a shape enables the upper blower duct 115 to be disposed adjacent to the driven roller 112 as illustrated in FIG. 33, and the curled sheet P can more easily contact an end portion 115*c* of the upper blower duct 115 on the upstream side in a sheet conveyance direction. Accordingly, the sheet P can be prevented from winding around the driven roller 112.

The upper blower duct 115 and the lower blower duct 116 have respective surfaces that are opposite each other. Each of such surfaces extends along a sheet conveyance path formed between the upper blower duct 115 and the lower blower duct 116. Each of the opposite surfaces functions as a guide for guiding a sheet P along the conveyance path, thereby preventing the sheet P from being jammed.

Figure 34:
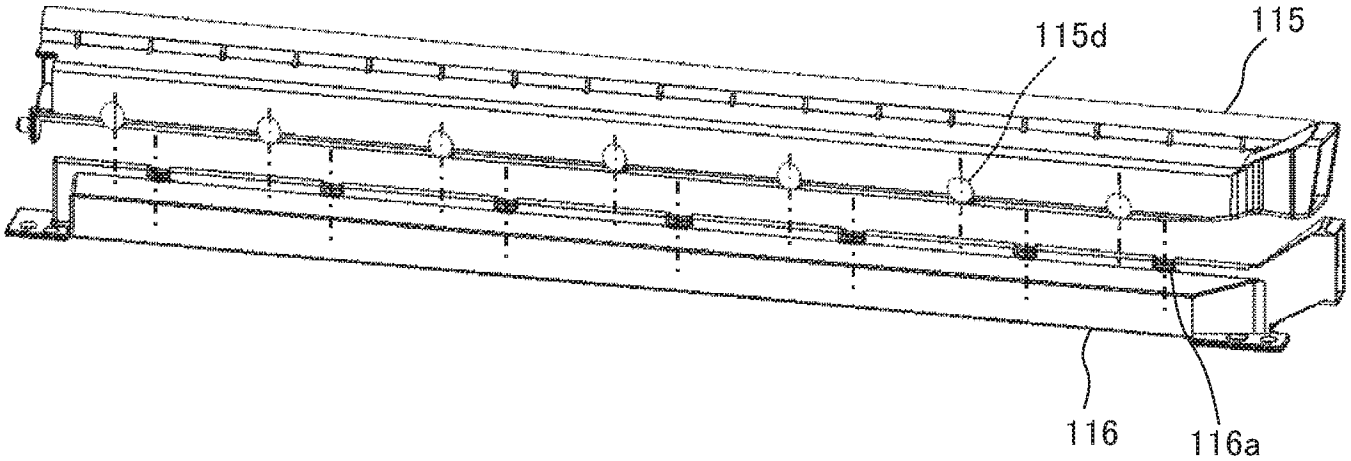
FIG. 34 is a perspective view illustrating the upper blower duct and the lower blower duct.

FIG. 34 is a perspective view illustrating the upper blower duct 115 and the lower blower duct 116. As illustrated in FIG. 34, the surface of the upper blower duct 115 opposite the lower blower duct 116 has a plurality of blower ports 115*d* aligned in a direction perpendicular to the sheet conveyance direction. Moreover, the surface of the lower blower duct 116 opposite the upper blower duct 115 has a plurality of blower ports 116*a* aligned in a direction perpendicular to the sheet conveyance direction. In a case where the number of the blower ports 115*d* and the number of the blower ports 116*a* become excessive, a cooling efficiency is decreased by reduction in flow velocity of air to be sent out. Hence, the number of the blower port 115*d* and the number of the blower ports 116*a* need to be appropriate.

In the conveying cooling unit 110, as illustrated in FIG. 34, a position of the blower port 115*d* of the upper blower duct 115 and a position of the blower port 116*a* of the lower blower duct 116 are shifted from each other. With such a configuration, the number of the blower ports 115*d* and the number of the blower ports 116*a* can remain appropriate, and airflow can be evenly applied across a sheet P, thereby efficiently cooling the sheet P.

An arrangement pitch of the plurality of blower ports 115*d* in the upper blower duct 115 is the same as an arrangement pitch of the plurality of blower ports 116*a* in the lower blower duct 116. Therefore, even if various sizes of sheets P are used, airflow can be evenly applied across the sheet P.

Figure 35:
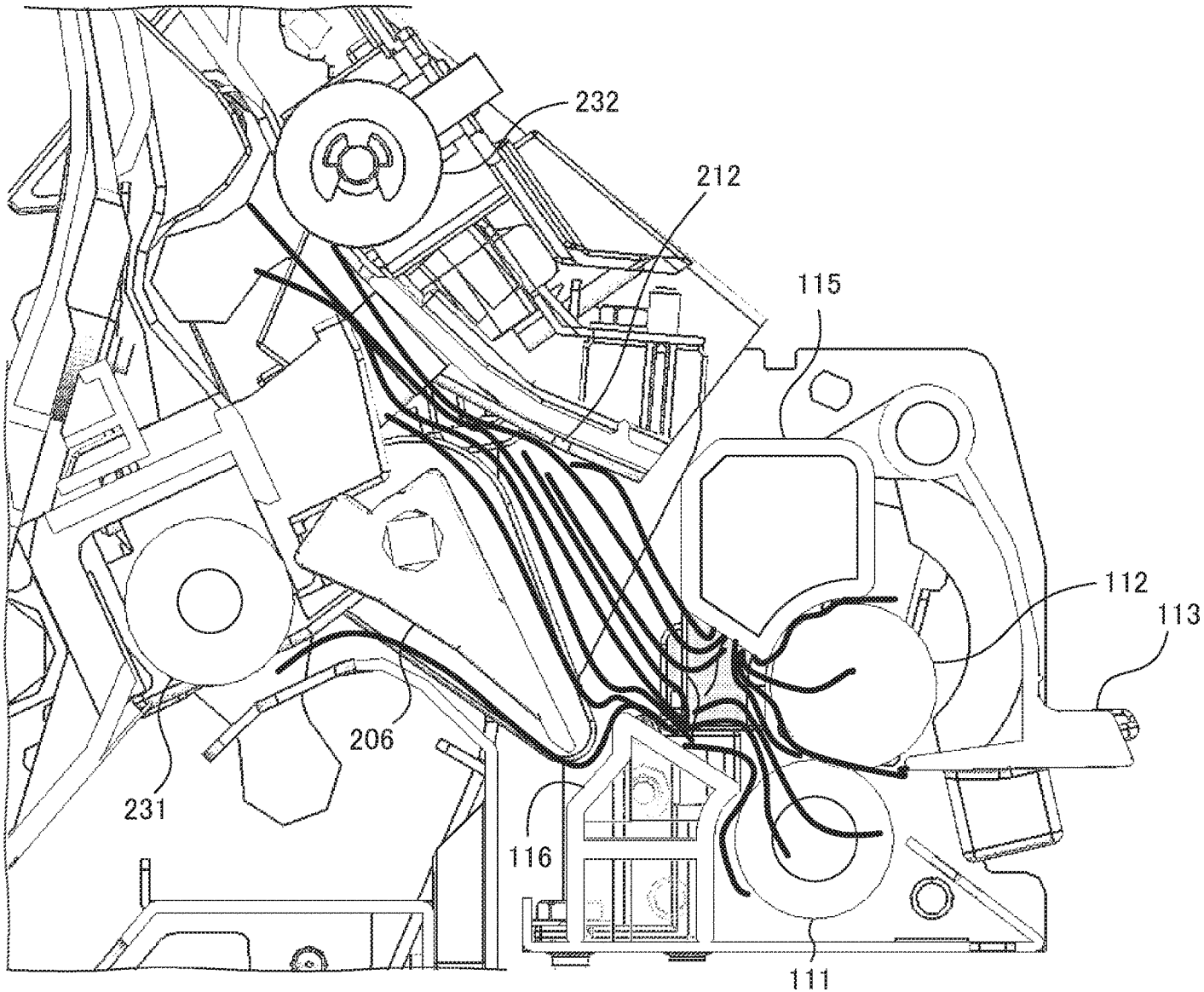
FIG. 35 is a diagram illustrating a cooling effect on peripheral members by the upper blower duct and the lower blower duct.

FIG. 35 is a diagram illustrating a cooling effect of the upper blower duct 115 and the lower blower duct 116 on peripheral members. When a sheet P is not being fed between the upper blower duct 115 and the lower blower duct 116, the air from the upper blower duct 115 and the air from the lower blower duct 116 collide with each other and the resultant air is vigorously sprayed to the periphery of the upper blower duct 115 and the lower blower duct 116 as illustrated in FIG. 35. On the upstream side of both of the upper blower duct 115 and the lower blower duct 116 in a sheet conveyance direction, airflow is applied to the drive roller 111 and the driven roller 112, thereby efficiently cooling the drive roller 111 and the driven roller 112. Moreover, the sheet P can be prevented from winding around the drive roller 111 and the driven roller 112, and toner can be prevented from firmly adhering to the drive roller 111 and the driven roller 112. In addition, airflow can be applied to the upper nip guide 113 made of resin, thereby efficiently cooling the upper nip guide 113.

The upper nip guide 113 is shaped to function as a barrier such that airflow from both of the upper blower duct 115 and the lower blower duct 116 does not flow toward an upstream side in the sheet conveyance direction. Such a shape of the upper nip guide 113 can prevent a decrease in fixing efficiency due to contact of the airflow from both of the upper blower duct 115 and the lower blower duct 116 with the fixing device 106.

On the downstream side of both of the upper blower duct 115 and the lower blower duct 116 in the sheet conveyance direction, airflow is applied to the switching tab 205 made of resin, the cover 212 made of resin, and rollers 231 and 232, thereby cooling the switching tab 205, the cover 212, and the rollers 231 and 232 with good efficiency.

The above description is merely one example. The present disclosure can provide the following effects.

[First Aspect]

A cooling device includes a duct (e.g., an upper blower duct 115), a moving mechanism (e.g., a moving mechanism 800), and an openable cover. The duct is disposed opposite a sheet conveyance path to send air to the sheet conveyance path (e.g., a post-transfer conveyance path 104 and a sheet ejection path 206). The moving mechanism moves the duct between an opposite position opposite the sheet conveyance path and a retracted position. The cover opens to expose the sheet conveyance path. The moving mechanism is configured such that the duct can be moved independently from the cover.

The configuration with the first aspect enables the duct to be retracted to the retracted position allowing removal of a jammed sheet by moving the duct for a shorter distance than a distance to be moved according to a configuration in which a duct is moved together with a cover that opens a sheet conveyance path. The movement distance of the duct is shortened, thereby preventing degradation in layout flexibility or an increase in size of the apparatus caused by movement of the duct between the opposite position and the retracted position.

[Second Aspect]

In the cooling device with the first aspect, the cover includes a guide (e.g., an upper ejection guide 212*b*) that guides one side or two sides of a sheet.

According to the second aspect, the guide that guides one side or two sides of a sheet is moved together with the opening of the cover, thereby facilitating removal of a jammed sheet near the duct.

[Third Aspect]

In the cooling device with the second aspect, the guide guides the sheet on a downstream side of a position opposite the duct in a sheet conveyance direction on the conveyance path, and the moving mechanism causes a portion of the duct opposite the conveyance path to move to a downstream side in the sheet conveyance direction in the course of movement of the duct from the opposite position to the retracted position.

According to the third aspect, after a user opens the cover, the duct is moved to a downstream side in the sheet conveyance direction by following movement of a jammed sheet to be pulled toward the downstream side in the sheet conveyance direction. Since the duct does not tend to interfere with the movement of the jammed sheet, removal of the jammed sheet can be facilitated.

[Fourth Aspect]

In the cooling device with the first, second, or third aspect, an elastic member (e.g., an elastic member 131) is fixed to the periphery of a communicating port of at least one of the duct and a connecting tube (e.g., a connecting tube 123) that communicates with the duct on an upstream side in a coolant movement direction. The duct and the connecting tube, which is not moved by the moving mechanism, are connected via the elastic member with movement of the duct from the retracted position to the opposite position by the moving mechanism.

According to the fourth aspect, the elastic member enhances the seal of a joint between the duct moved from the retracted position to the opposite position and the connecting tube in a fixed position, thereby preventing a decrease in cooling efficiency due to leakage of the coolant from a clearance between the duct and the connecting tube.

[Fifth Aspect]

In the cooling device with the fourth aspect, the moving mechanism is configured such that the duct is urged by an urging unit (e.g., a torsional spring 118) to press against the elastic member disposed between the duct and the connecting tube.

According to the configuration, the urging member presses the elastic member with an urging force, thereby enhancing the sealed property of the joint between the connecting tube and the duct in the opposite position.

[Sixth Aspect]

In the cooling device with the fifth aspect, a positioning member is disposed that renders the duct to be urged by the urging member contact the positioning member to set a position of the duct.

According to the sixth aspect, a position of the duct in the opposite position is set by the positioning member, thereby preventing a decrease in cooling efficiency due to vibration or displacement of the duct.

[Seventh Aspect]

In the cooling device with any of the first through sixth aspects, the duct has a shape that is curved along a curved surface of a conveyance roller (e.g., a driven roller 112) that applies a conveyance force to the sheet near the duct.

According to the seventh aspect, the duct having the curved shape is disposed adjacent to the conveyance roller, and an end portion of the duct on the side of the conveyance roller functions as a separation tab that facilitates separation of the sheet from the conveyance roller, thereby preventing the sheet from winding around the conveyance roller.

[Eighth Aspect]

In the cooling device with any of the first through seventh aspects, the duct has a surface opposite the conveyance path, and the surface extends along the sheet conveyance direction.

According to the eighth aspect, the duct functions as a guide that guides movement of the sheet along the conveyance path, thereby preventing a sheet jam in a position opposite the duct.

[Ninth Aspect]

In the cooling device with any of the first through eighth aspects, another duct is disposed. The two ducts are disposed opposite each other to send air to respective surfaces of the sheet passing a portion of the conveyance path between the two ducts. One of the ducts is moved by the moving mechanism.

According to the ninth aspect, the sheet can be cooled from both sides with good efficiency. Moreover, when a sheet is not passing, the air from one duct and the air from the other duct collide with each other and the resultant air is vigorously sprayed to peripheral members, thereby preventing an increase in temperature of the peripheral members.

[Tenth Aspect]

In the cooling device with the ninth aspect, each of the two ducts includes a plurality of blower ports that send air, and positions of the blower ports of the two ducts are shifted from each other.

According to the tenth aspect, the air can be evenly sprayed across the sheet while a decrease in cooling efficiency due to an excessive number of blower ports is being prevented.

[Eleventh Aspect]

In the cooling device with the ninth or tenth aspect, the connecting tube which communicates with the duct on an upstream side in an airflow movement direction includes a receiving portion (e.g., a receiving potion 123*a*), a first communicating portion (e.g., a first communicating portion 123*b*), and a second communicating portion (e.g., a second communicating portion 123*c*). The receiving portion receives airflow. The first communicating portion diverges from the receiving potion to communicate with one of the ducts, whereas the second communicating portion diverges from the receiving portion to communicate with the other duct.

According to the eleventh aspect, a single blower unit (e.g., an air supply fan 124) sends airflow to each of the two ducts. Hence, the device can be made at lower cost and more compact.

[Twelfth Aspect]

In the cooling device with any of the first through eleventh aspects, the cover includes a holding member (e.g., a hinge 212*a*) that rotatably holds the cover, and the moving mechanism renders the duct be rotated about a hinge line (e.g., a fixed shaft 117) positioned nearer to the duct than the cover such that the duct is moved between the opposite position and the retracted position.

According to the twelfth aspect, the duct can be moved between the opposite position and the retracted position by the simple moving mechanism.

[Thirteenth Aspect]

An image forming apparatus (e.g., a copier) includes an image recording unit (e.g., an image forming unit 2), a fixing unit (e.g., a fixing device 106), and a cooling unit (e.g., a conveying cooling unit 110). The image recording unit records an image on a sheet. The fixing unit fixes the image recorded by the image recording unit on the sheet. The cooling unit cools the sheet fed from the fixing unit. The cooling device with any of the first through twelfth aspects is used as the cooling unit.

The present disclosure has been described above with reference to specific exemplary embodiments but is not limited thereto. Various modifications and enhancements are possible without departing from scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A cooling device comprising:

a duct disposed opposite a sheet conveyance path and configured to send air to the sheet conveyance path;

an openable cover configured to expose the sheet conveyance path when the cover is opened; and a moving mechanism configured to move the duct independently of the cover between an opposite position opposite the sheet conveyance path and a retracted position.

2. The cooling device according to claim 1, wherein the cover includes a guide configured to guide one side or two sides of a sheet.

3. The cooling device according to claim 2, wherein the guide guides the sheet on a downstream side of a position opposite the duct in a sheet conveyance direction on the sheet conveyance path, and wherein the moving mechanism moves a portion of the duct opposite the sheet conveyance path to a downstream side in the sheet conveyance direction in a course of movement of the duct from the opposite position to the retracted position.

4. The cooling device according to claim 1, further comprising:

a connecting tube that communicates with the duct on an upstream side in an airflow movement direction; and an elastic member fixed to periphery of a communicating port of at least one of the duct and the connecting tube, wherein the duct and the connecting tube that is not moved by the moving mechanism are connected via the elastic member with movement of the duct from the retracted position to the opposite position by the moving mechanism.

5. The cooling device according to claim 4, wherein the moving mechanism causes the duct to be urged by an urging member to press against the elastic member disposed between the duct and the connecting tube.

6. The cooling device according to claim 5, further comprising a positioning member configured to cause the duct to be urged by the urging member contact the positioning member to set a position of the duct.

7. The cooling device according to claim 1, wherein the duct has a shape that is curved along a curved surface of a conveyance roller that applies a conveyance force to a sheet near the duct.

8. The cooling device according to claim 1, wherein the duct has a surface opposite the conveyance path and extending along a sheet conveyance direction.

9. The cooling device according to claim 1, further comprising another duct, wherein the duct and said another duct are disposed opposite each other to send air to respective surfaces of the sheet passing a portion of the conveyance path between the duct and said another duct, and wherein only the duct of the duct and said another duct is moved by the moving mechanism.

10. The cooling device according to claim 9, wherein each of the duct and said another duct includes a plurality of blower ports that send air, and the blower ports are shifted from each other.

11. The cooling device according to claim 9, further comprising a connecting tube that communicates with the duct on an upstream side in an airflow movement direction, wherein the connecting tube includes:

a receiving portion that receives airflow;

a first communicating portion that diverges from the receiving potion to communicate with one duct of the duct and said another duct; and a second communicating portion that diverges from the receiving portion to communicate with the other duct of the duct and said another duct.

12. The cooling device according to claim 1, wherein the cover includes a holding member configured to rotatably hold the cover, and wherein the moving mechanism causes the duct to be rotated about a hinge line positioned nearer to the duct than a hinge line of the cover, and the duct is moved between the opposite position and the retracted position.

13. An image forming apparatus comprising:

an image recording device configured to record an image on a sheet;

a fixing device configured to fix the image recorded by the image recording device on the sheet, the fixing device located downstream from the image recording device in a sheet conveyance direction; and the cooling device according to claim 1 configured to cool the sheet fed from the fixing device, the cooling device located downstream from the fixing device in the sheet conveyance direction.

* * * * *